US005344274A

United States Patent [19]

Everhard et al.

[11] Patent Number: 5,344,274

[45] Date of Patent: Sep. 6, 1994

[54] ENVELOPE REMOVAL APPARATUS

[75] Inventors: Paul R. Everhard, Nicholasville; Alan L. Everhard, Lexington; Frank T. Moran, Lexington; Gergory J. Omvig, Lexington, all of Ky.

[73] Assignee: Everhard Automation Controls, Inc., Lexington, Ky.

[21] Appl. No.: 973,044

[22] Filed: Nov. 6, 1992

[51] Int. Cl.[5] ..... B65B 69/00

[52] U.S. Cl. ..... 414/412; 414/786

[58] Field of Search ..... 414/412, 786; 83/861, 83/884, 885, 946

[56] References Cited

U.S. PATENT DOCUMENTS

| | | | |
|---|---|---|---|
| 3,196,917 | 7/1965 | Frank | 83/865 |
| 3,386,320 | 6/1968 | Pinkham et al. | 83/946 X |
| 3,457,642 | 7/1969 | Steer et al. | 83/946 X |
| 3,548,694 | 12/1970 | Gelardi | 83/861 |
| 3,664,530 | 5/1972 | Takiguchi | 414/412 |
| 3,889,442 | 6/1975 | Grahn et al. | 414/412 X |
| 4,036,380 | 7/1977 | Berry et al. | 414/412 |
| 4,162,019 | 7/1979 | Joa | 414/412 |
| 4,997,329 | 3/1991 | Hanamoto et al. | 414/412 |
| 5,090,864 | 2/1992 | Leifeld | 414/412 |
| 5,101,703 | 4/1992 | Tanaka et al. | 83/946 X |

FOREIGN PATENT DOCUMENTS

| | | | |
|---|---|---|---|
| 0404272 | 12/1990 | European Pat. Off. | 414/412 |
| 3229765 | 2/1984 | Fed. Rep. of Germany | 414/412 |
| 1402498 | 6/1988 | U.S.S.R. | 414/412 |
| 1613385 | 12/1990 | U.S.S.R. | 414/412 |

*Primary Examiner*—David A. Bucci
*Attorney, Agent, or Firm*—Frank C. Leach, Jr.

[57] ABSTRACT

A sealed envelope, which encloses a rectangular shaped container having an audio or video tape therein to form a package, is automatically removed from the container through cutting a first edge of the envelope during its travel in a first direction and then cutting two substantially parallel edges, perpendicular to the first cut edge, during travel of the container in a second direction perpendicular to the first direction. After the three edges of the envelope have been cut, air pressure is selectively applied towards the cut edges. Then, flexible tubes apply forces to the top and bottom of the cut envelope to partially remove it from the container prior to the container being advanced in the second direction to an area in which a vacuum is applied to remove the cut envelope from the container. The packages are initially stacked in a magazine with each package being advanced from the magazine in the first direction in a predetermined spacing from the prior package. When the container has an audio tape, friction wipers on opposite sides of the container partially remove the cut envelope from the container prior to the air pressure being applied.

30 Claims, 16 Drawing Sheets

FIG. 15
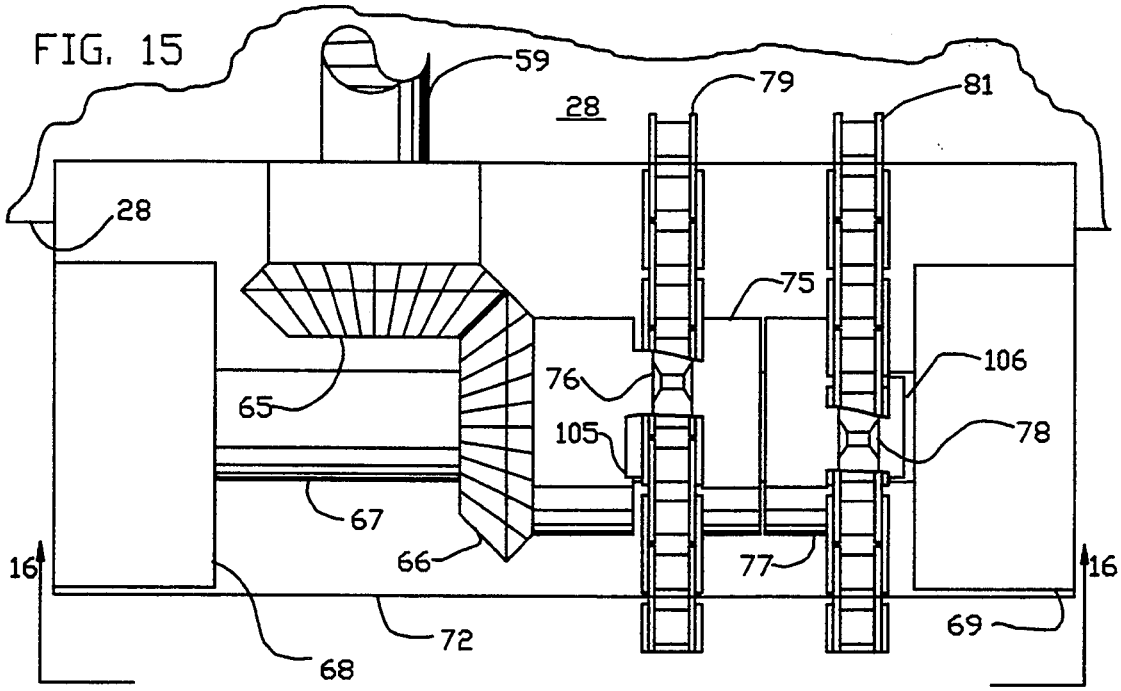
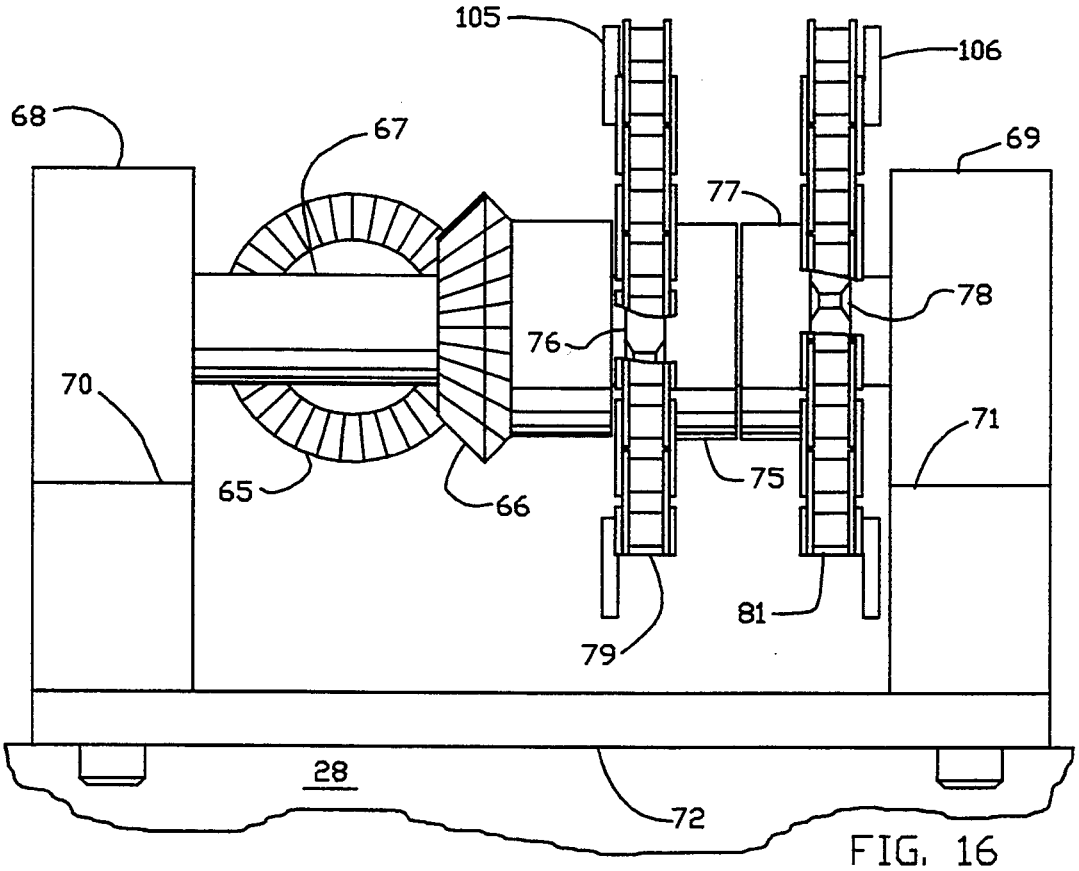
FIG. 16

ENVELOPE REMOVAL APPARATUS

This invention relates to an envelope removal apparatus and, more particularly, to an apparatus for removing a sealed envelope or wrapper from a rectangular shaped container enclosed by the sealed envelope or wrapper.

Audio and video tapes having recorded material thereon are sold by retailers in a container enclosed by a sealed envelope such as a plastic film, for example, that may be shrink-wrapped, for example. The retailer usually places a price label or other identifying material on the exterior of the envelope and usually with an adhesive retaining material.

When the audio or video tape fails to sell, the retailer returns the sealed package to a wholesaler or other distributor. Before the wholesaler can sell the container with the tape therein to another retailer, it is necessary to remove the sealed envelope from the container because of the presence of the prior retailer's label due to it being adhered to the envelope. After removal of the envelope, the container is again enclosed within a new sealed envelope.

The sealed envelopes are presently removed from the containers manually. This requires a number of employees to handle a certain number of the containers each day. Thus, there is a substantial labor cost for the wholesaler.

The apparatus of the present invention satisfactorily solves the relatively large labor cost problem through automatically removing the sealed envelope from the container having the tape therein. When a magazine having the sealed containers stacked therein is used as the source of supply with the apparatus of the present invention, it is only necessary to have one person to stack the containers in the magazine. Accordingly, a substantial reduction in labor cost is achieved.

An object of this invention is to automatically remove a sealed envelope from a container that the sealed envelope encloses.

Other objects of this invention will be readily perceived from the following description, claims, and drawings.

This invention relates to an apparatus for removing a sealed envelope in one piece from at least one rectangular shaped container enclosed by the sealed envelope. The apparatus includes first cutting means for cutting a first edge of the sealed envelope on a first side of the container. A second edge of the envelope on a second side of the container substantially perpendicular to the first side of the container is cut by second cutting means and a third edge of the envelope on a third side of the container is cut by third cutting means substantially parallel to the second side of the container Each of the first, second, and third cut edges of the envelope and a fourth edge of the envelope on a fourth side of the container but substantially parallel to the first side of the container are in the same plane and at least a portion of the fourth edge remains attached to the rest of the envelope after cutting is completed so that the envelope remains one piece. First relative moving means produces relative movement between the container and the first cutting means to enable the first cutting means to cut the first edge of the envelope on the first side of the container. Second relative moving means produces relative movement between the container and each of the second cutting means and the third cutting means to enable the second cutting means to cut the second edge of the envelope on the second side of container and the third cutting means to cut the third edge of the envelope on the third side of the container. Removal means removes the cut envelope in one piece from the container after the second and third cutting means have been effective. This invention also relates to a method for removing a sealed envelope in one piece from at least one rectangular shaped container enclosed by the sealed envelope including cutting a first edge of the sealed envelope on a first side of the container, cutting a second edge of the envelope on a second side of the container substantially perpendicular to the first side of the container with the second edge being in the same plane as the first edge, and cutting a third edge of the envelope on a third side of the container substantially parallel to the second side of the container with the third edge being in the same plane as the first edge and the second edge. Leaving at least a portion of the fourth edge of the envelope on a fourth side of the container substantially parallel to the first side of the container and in the same plane as the first edge, the second edge, and the third edge integral with the rest of the envelope after cutting is completed so that the envelope is one piece. Removing the cut envelope as one piece from the container after cutting of the first edge, the second edge, and the third edge has been completed.

The attached drawings illustrate preferred embodiments of the invention, in which:

FIG. 15 is an enlarged fragmentary top plan view of a portion of the apparatus of FIG. 1B showing a support for a gearing arrangement that transmits drive between chains advancing perpendicular to each other;

FIG. 16 is an enlarged fragmentary end elevational view of a portion of the apparatus of FIG. 1B showing the support for support a gearing arrangement that transmits a drive between chains advancing perpendicular to each other and taken along line 16—16 of FIG. 15;

Figures 1, 1A, 1B:
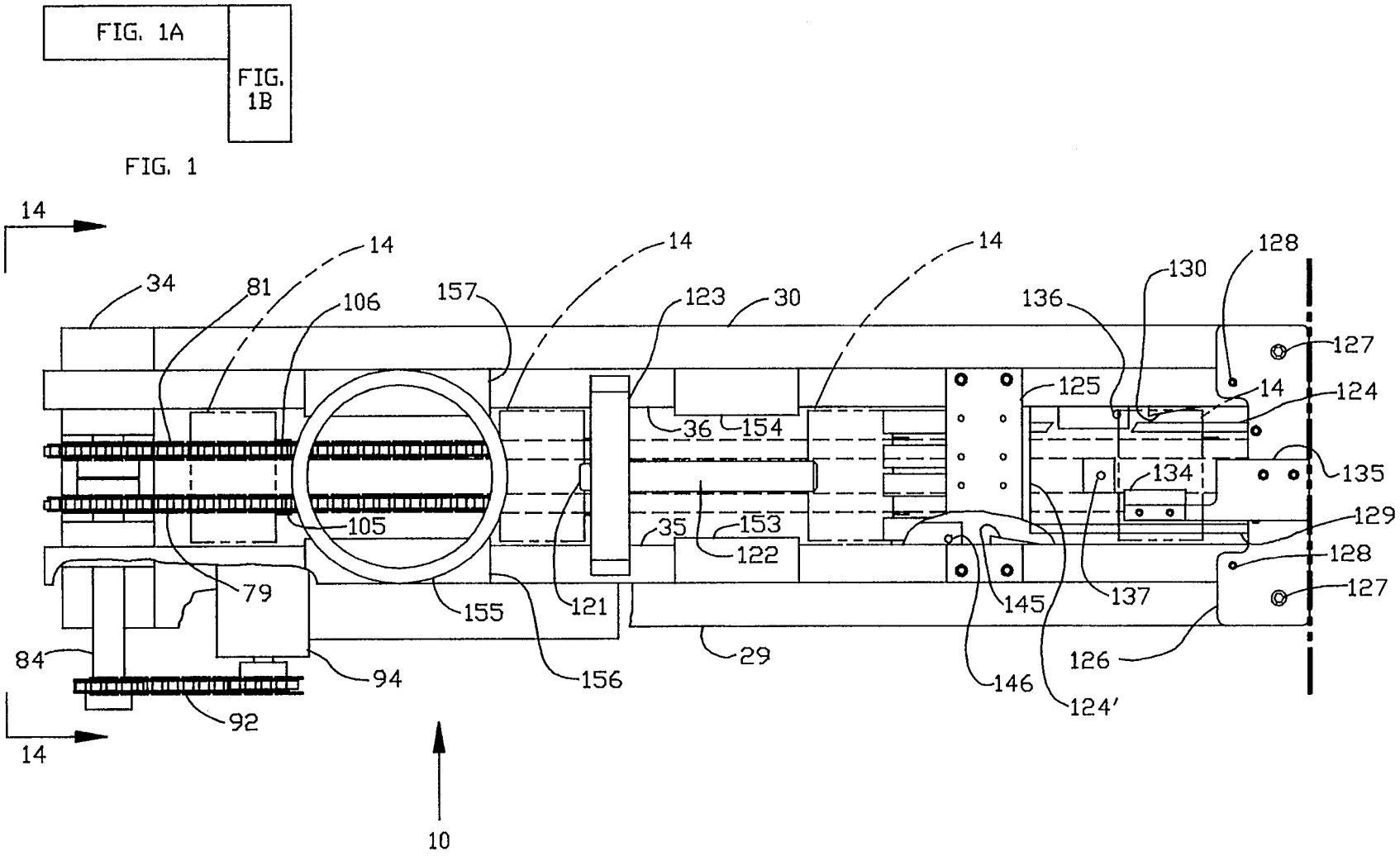
FIG. 1 is a block diagram showing the relation of FIGS. 1A and 1B.
FIG. 1A is a top plan view of a portion of an embodiment of an envelope removal apparatus of the present invention.
FIG. 1B is a top plan view of the remainder of the envelope removal apparatus.
Figure 1B:
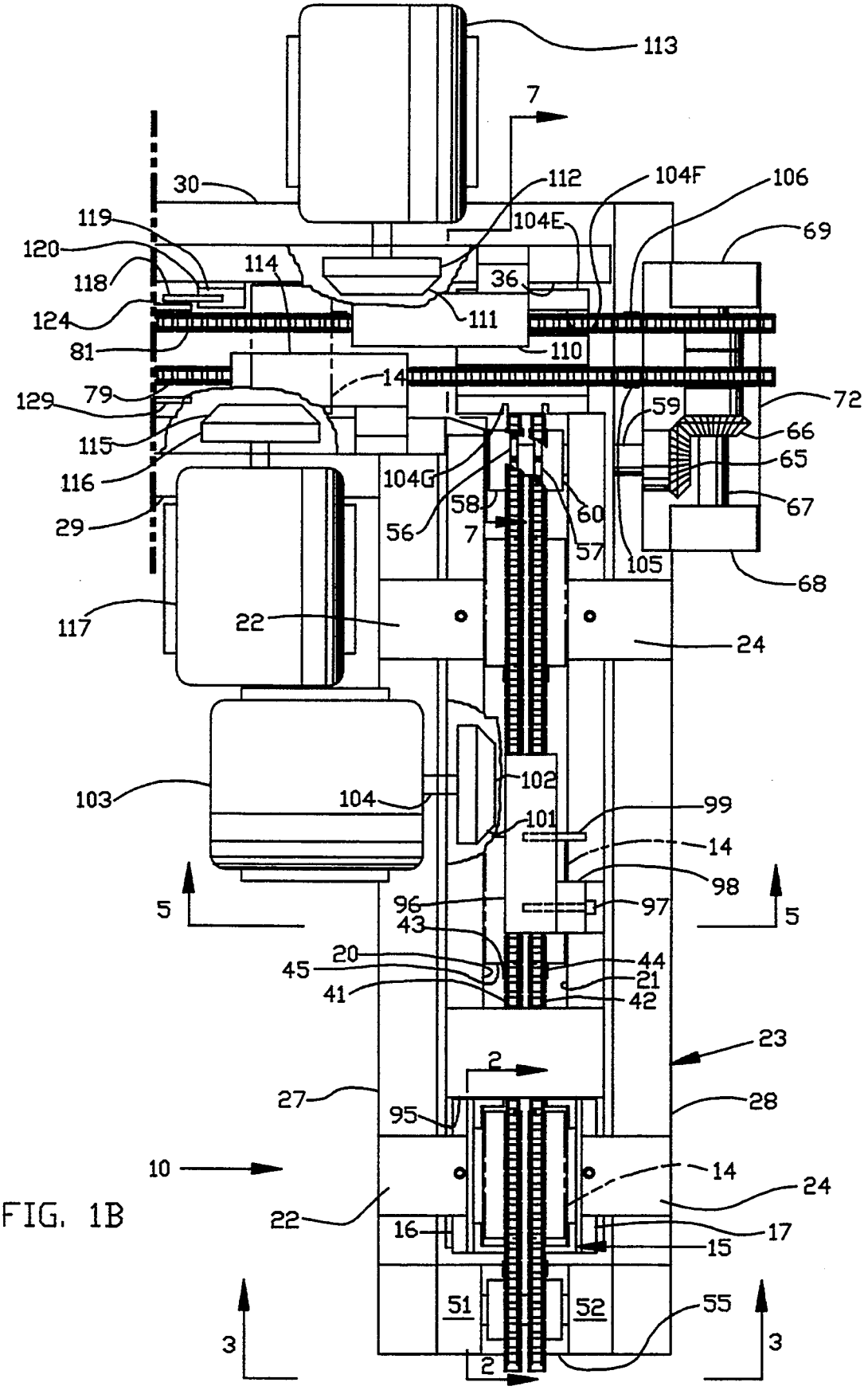
Figure 4:
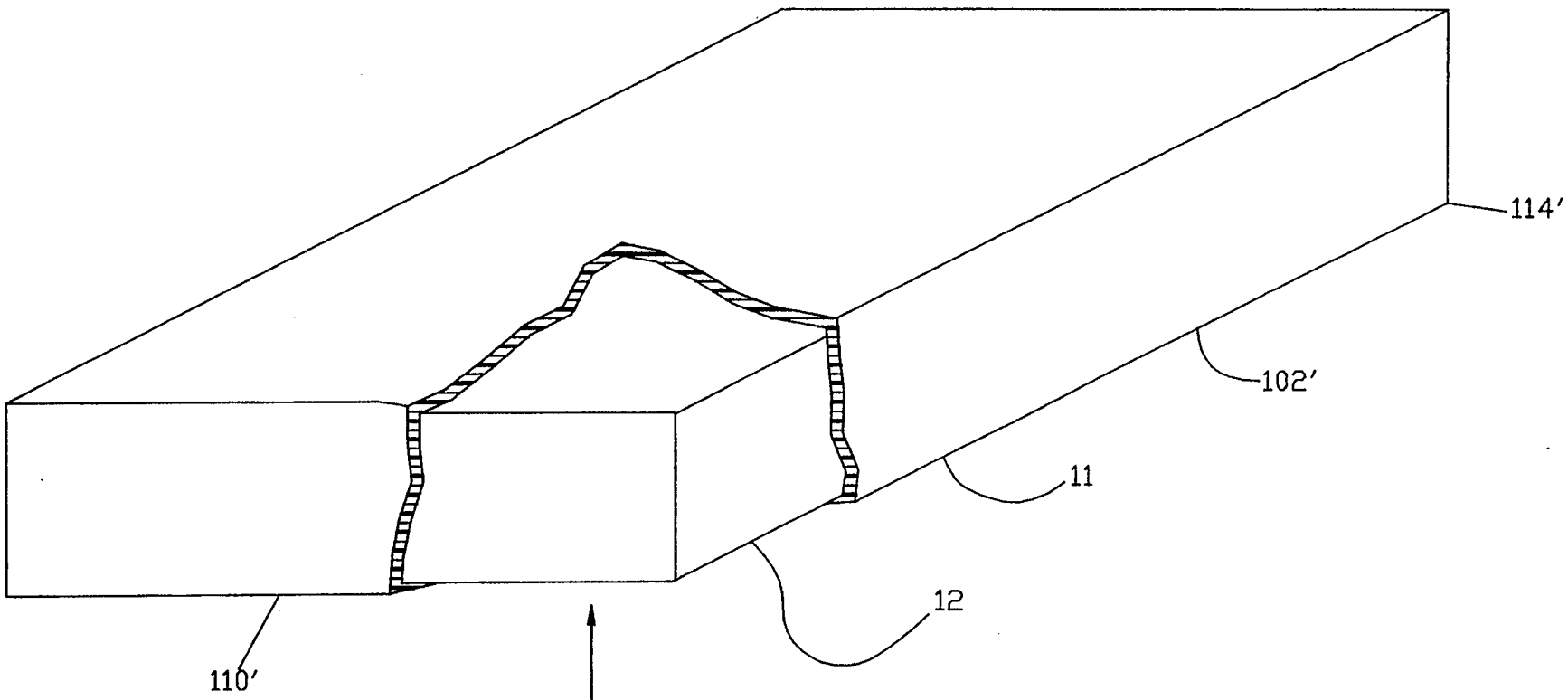
FIG. 4 is an enlarged fragmentary elevational view, partly in section, of a package including a container and a sealed envelope to be removed from the container by the apparatus of the present invention.

Referring to the drawings and particularly FIG. 1B, there is shown an apparatus 10 for removing a sealed envelope 11 (see FIG. 4) enclosing a rectangular shaped container 12. The sealed envelope 11 may be a plastic film, for example, that may be shrink-wrapped, for example; however, the sealed envelope 11 does not have to have a shrink-wrap fit on the container 12.

The container 12 has an audio tape (not shown) therein. The envelope 11 and the container 12 form a rectangular shaped package 14.

The packages 14 (see FIG. 3) are arranged in a stacked relation within a magazine 15 having two L-shaped rails 16 and 17 at its bottom supported on a pair of substantially parallel L-shaped guide rails 20 and 21, respectively. The guide rail 20 is supported adjacent each of its ends by a plate 22 of a frame 23, and the guide rail 21 is supported adjacent each of its ends by a plate 24 of the frame 23.

Each of the plates 22 is mounted on the upper end of one of a pair of longitudinally spaced legs or uprights 25 of the frame 23. Each of the plates 24 is mounted on the upper end of one of a pair of longitudinally spaced legs or uprights 26 of the frame 23. Each of the legs 25 is aligned with one of the legs 26 so that there are two pairs of the aligned legs 25 and 26.

Each of the two longitudinally spaced legs 25 extends upwardly from a substantially horizontally extending square tube 27, and each of the two longitudinally spaced legs 26 extends upwardly from a substantially horizontally extending square tube 28, which is substantially parallel to the square tube 27. Each of the legs 25, the legs 26, the square tube 27, and the square tube 28 is a two inch square tube.

The frame 23 also includes a pair of substantially horizontally disposed square tubes 29 (see FIG. 1A) and 30, which are substantially perpendicular to the tubes 27 (see FIG. 1B) and 28 and in the same horizontal plane. The end of the square tube 29 abuts the side of the tube 27 adjacent its end, and the end of the tube 30 abuts the side of the tube 28 adjacent its end. It should be understood that the tubes 27, 28, 29, and 30 are supported a predetermined distance above a floor by a suitable support structure (not shown).

Two longitudinally spaced legs or uprights 31 (see FIG. 9) extend upwardly from the tube 29 (see FIG. 1A). Three longitudinally spaced legs or uprights 32 (see FIG. 9) extend upwardly from the tube 30 (see FIG. 1A).

One of the two legs 31 (see FIG. 14), which is at the end of the tube 29 (see FIG. 1A) remote from the tube 27 (see FIG. 1B) and aligned with one of the end legs 32 (see FIG. 14), has a plate 33 secured to its upper end, and each of the two end legs 32 has a plate 34 secured to its upper end. The plate 33 supports an L-shaped guide rail 35 adjacent one end of the guide rail 35, and the plates 34 support an L-shaped guide rail 36 adjacent each of its ends. The other of the two legs 31 is intermediate the ends of the tube 29 (see FIG. 1A) and is aligned with the third leg 32 (see FIG. 9), which is intermediate the two end legs 32.

Each of the tubes 29 (see FIG. 1A) and 30 is the same as each of the tubes 27 (see FIG. 3) and 28. Each of the guide rails 35 (see FIG. 9) and 36 is the same as the guide rails 20 (see FIG. 3) and 21. Each of the plates 33 (see FIG. 14) and 34 is the same as the plates 22 (see FIG. 3) and 24. Each of the legs 31 (see FIG. 9) and 32 is the same as the legs 25 (see FIG. 3) and 26 except that each of the legs 31 (see FIG. 9) and 32 has a cutout at its upper end.

The lowermost of the packages 14 (see FIG. 3) in the magazine 15 falls downwardly therefrom by gravity to rest on a pair of substantially horizontal parallel support bars 39 and 40. The support bars 39 and 40, which extend longitudinally, are supported on a plate 40', which is secured by screws (not shown) to one of the pairs of the aligned legs 25 and 26. The bottom of the lowermost of the stacked packages 14 is held above the path of travel of each of a pair of endless chains 41 and 42 by the support bars 39 and 40.

The chain 41 has a plurality of lugs 43 mounted thereon at predetermined spaced longitudinal intervals greater than the dimension of the package 14 in the direction of its travel produced by one of the lugs 43 engaging one edge of the package 14 as shown in FIG. 1B. The chain 42 has lugs 44 (see FIG. 3), which are aligned with the lugs 43. Accordingly, the lowermost of the stacked packages 14 is advanced by one of the lugs 43 and one of the lugs 44 simultaneously engaging an edge 45 (see FIG. 2) of the package 14. Because of the support bars 39 and 40 (see FIG. 3) preventing the package 14 from falling onto the chains 41 and 42, the lugs 43 and 44 control the spaced locations of the packages 14.

Figure 2:
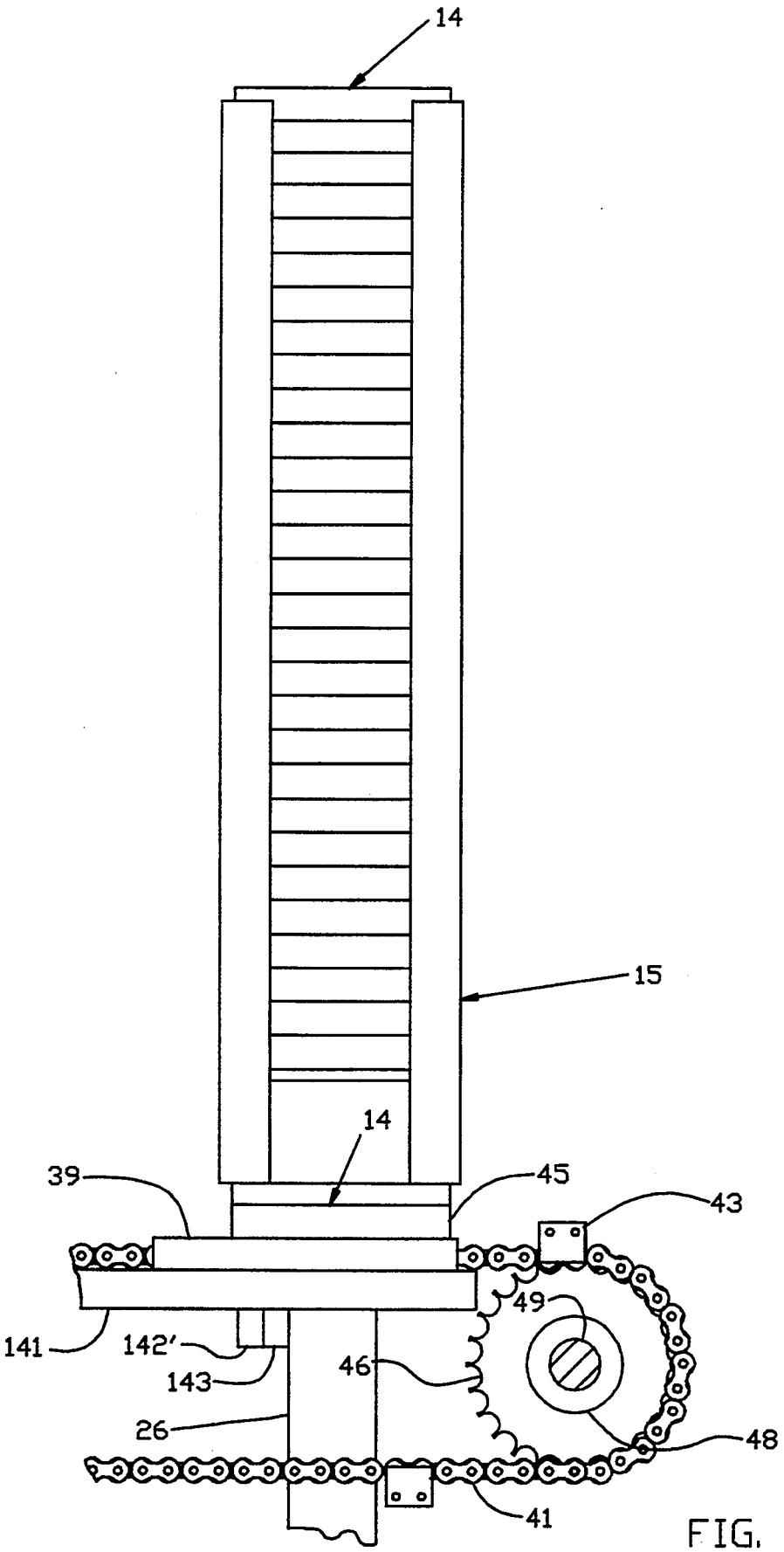
FIG. 2 is a fragmentary side elevational view of a portion of the apparatus of FIG. 1B showing a magazine having packages in a stacked relation with one of the packages being removed from the magazine and taken along line 2—2 of FIG. 1B.
Figure 3:
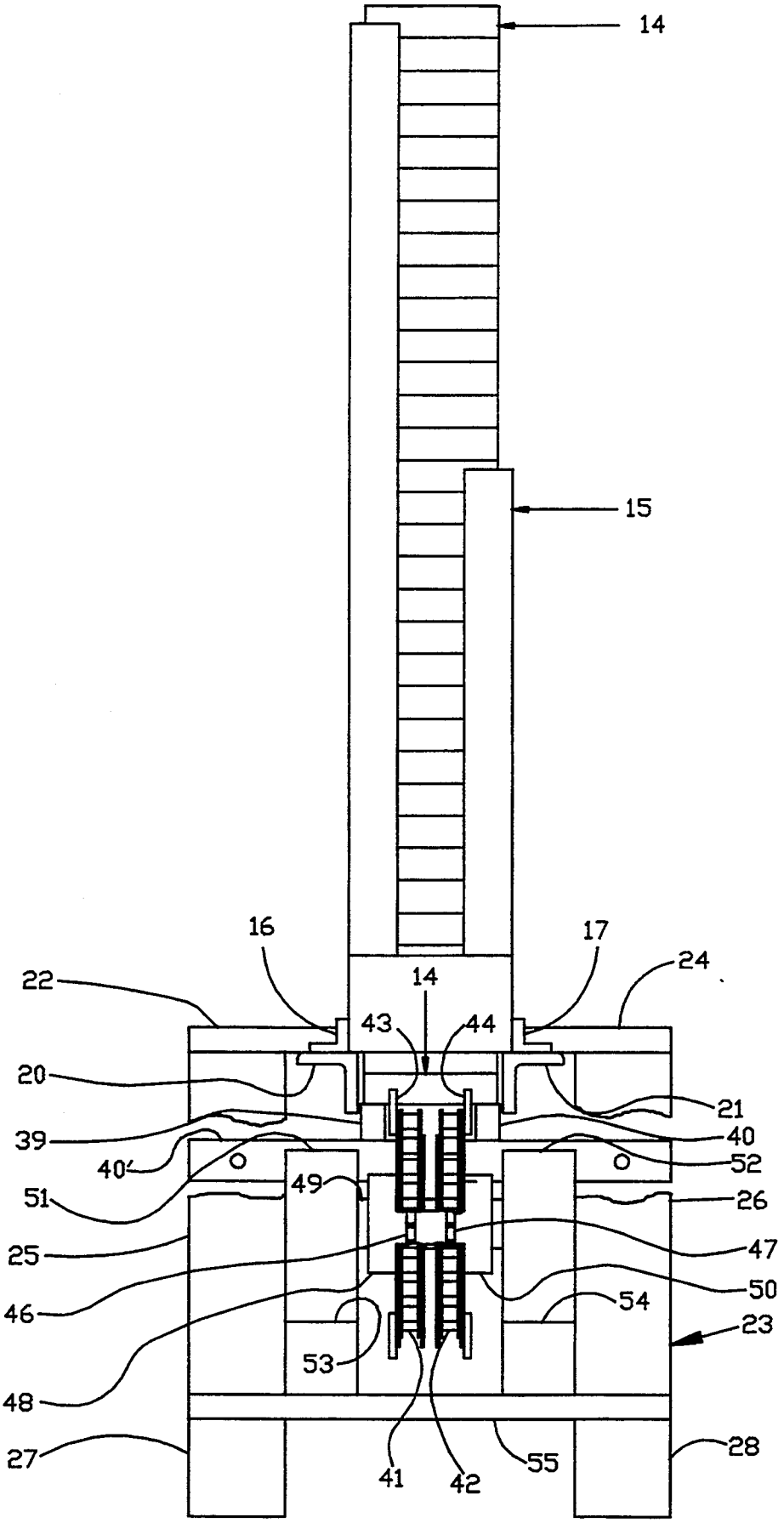
FIG. 3 is a rear elevational view of the magazine of FIG. 2 and taken along line 3—3 of FIG. 1B.

As soon as the lowermost of the stacked packages 14 ceases to support the package 14 above it due to advancement of the lowermost of the stacked packages 14 to the left in FIG. 2, the next lowermost of the stacked packages 14 falls downwardly from the magazine 15 by gravity to rest on the support bars 39 and 40 (see FIG. 3). The package 14 remains in this position until the next of the lugs 43 on the chain 41 and the corresponding aligned lug 44 on the chain 42 simultaneously engage the edge 45 (see FIG. 2) of the package 14.

The chain 41 extends around a sprocket 46, and the chain 42 (see FIG. 3) extends around a sprocket 47. The sprocket 46 (see FIG. 2) has an integral hub 48 supported on a shaft 49, which also has an integral hub 50 (see FIG. 3) of the sprocket 47 supported thereon.

The shaft 49 has its ends supported in bearing blocks 51 and 52. The bearing block 51 is attached to a spacer 53, and the bearing block 52 is attached to a spacer 54. The spacers 53 and 54 are supported by a support plate 55, which is supported on the tubes 27 and 28.

The chain 41 also passes around a sprocket 56 (see FIG. 7), and the chain 42 (see FIG. 1B) also passes around a sprocket 57. The sprocket 56 (see FIG. 7) has an integral hub 58 mounted on a shaft 59, which has an integral hub 60 (see FIG. 1B) of the sprocket 57 mounted thereon. The shaft 59 has one end supported in a bearing block 61 (see FIG. 7), and an intermediate portion of the shaft 59 is supported in a bearing block (not shown) in the same manner as the shaft 49 (see FIG. 3) is supported.

The other end of the shaft 59 (see FIG. 15) has a bevel gear 65 fixed thereon for meshing with a bevel gear 66, which is fixedly mounted on a shaft 67 intermediate its ends. The shaft 67 has its opposite ends supported in bearing blocks 68 and 69. The bearing block 68 is attached to a spacer 70 (see FIG. 16), and the bearing block 69 is attached to a spacer 71. The spacers 70 and 71 are supported on a support plate 72, which is welded to the tube 28 of the frame 23 (see FIG. 1B).

The shaft 67 (see FIG. 15) has an integral hub 75 of a chain sprocket 76 mounted thereon and an integral hub 77 of a chain sprocket 78 mounted thereon. An endless chain 79 passes around the chain sprocket 76 and a chain sprocket 80 (see FIG. 14). An endless chain 81 (see FIG. 15) passes around the chain sprocket 78 and a chain sprocket 82 (see FIG. 14).

The chain sprocket 80 has an integral hub 83 mounted on a shaft 84 for rotation therewith. The shaft 84 also has an integral hub 85 of the sprocket 82 mounted thereon for rotation therewith. The shaft 84 has one end supported in a bearing block 86. Intermediate its ends, the shaft 84 is supported in a bearing block 87.

The bearing block 86 is supported on a spacer 88, and the bearing block 87 is supported on a spacer 89. The spacers 88 and 89 are supported by a support plate 89', which is supported on the tubes 29 and 30 of the frame 23.

The shaft 84 has a sprocket 90 on its other end and around which an endless chain 91 passes. The chain 91 also passes around a sprocket 92 on an end of a shaft 93 of a motor 94. The motor 94 is supported by the tube 29 of the frame 23.

Accordingly, the endless chains 79 and 81 are driven at the same rate as the endless chains 41 (see FIG. 1B) and 42. This is because the teeth on the gears 65 and 66 are equal in number.

As the package 14 (see FIG. 2) is advanced to the left in FIG. 2 from the bottom of the magazine 15, the package 14 passes underneath a bar 95 (see FIG. 1B) extending between the guide rails 20 and 21 and supported thereby. The bar 95 prevents the front end of the package 14 (see FIG. 2) from rising due to the weight of the stacked packages 14 within the magazine 15 acting on the rear end of the package 14 being advanced to the left in FIG. 2.

Figure 5:
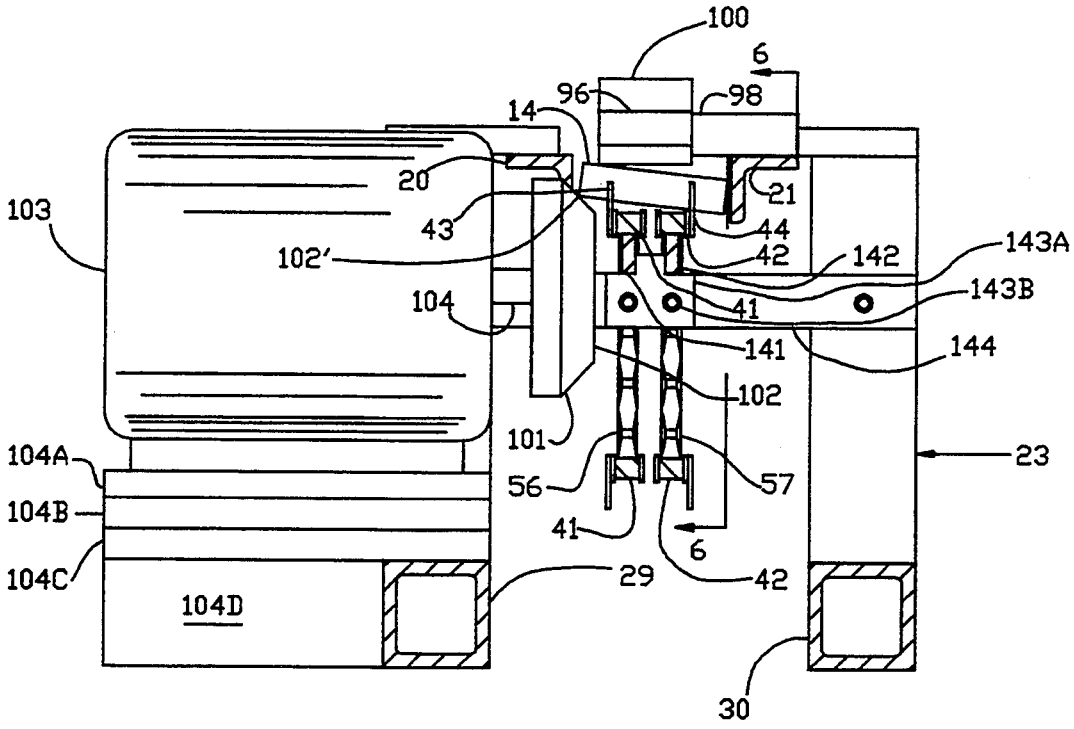
FIG. 5 is a sectional view of a portion of the apparatus of FIG. 1B and showing cutting means for cutting one edge of the sealed envelope from the container and taken along line 5—5 of FIG. 1B.
Figure 6:
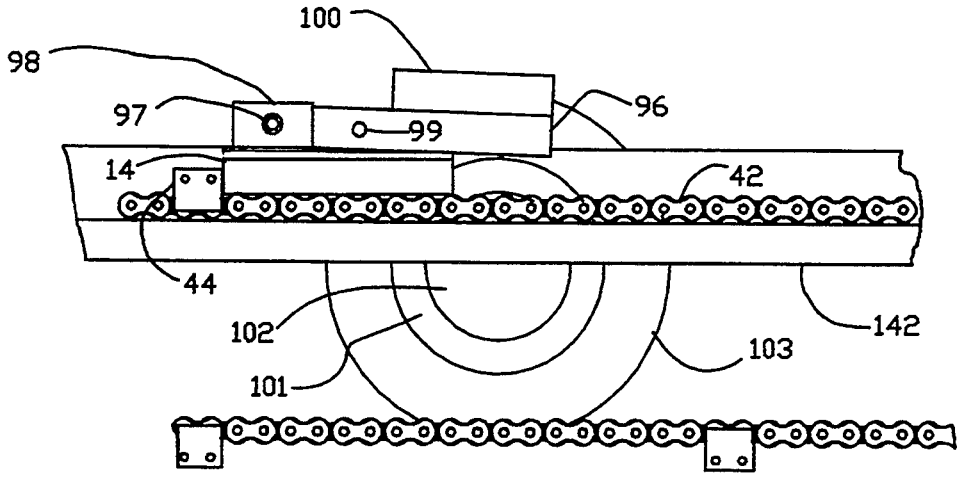
FIG. 6 is a fragmentary side elevational view of FIG. 5 taken along line 6—6 of FIG. 5.

As the package 14 is advanced by the chains 41 and 42 (see FIG. 1B) past the bar 95, the package 14 (see FIG. 6) passes beneath a pivotally mounted hold down plate 96. The hold down plate 96 is pivotally mounted on a pivot pin 97, which is supported by a plate 98. As shown in FIG. 5, the plate 98 is mounted on the guide rail 21.

The hold down plate 96 (see FIG. 6) has a stop pin 99 mounted therein and extending therefrom above the guide rail 21 (see FIG. 5) to limit the downward motion of the hold down plate 96. The hold down plate 96 has a weight 100 (see FIG. 6) on its forward end (right end in FIG. 6) remote from the pivot pin 97 to increase the force on the package 14 as it passes beneath the pivotally mounted hold down plate 96 (see FIG. 5).

As the package 14 is advanced beneath the hold down plate 96, the package 14 engages a beveled or angled, flat surface 101 of a cutting wheel 102, which is formed of a heat treated steel. This engagement causes tilting of the package 14 so that a first edge 102' of the package 14 rides on the beveled, flat surface 101. The cutting wheel 102 includes a cylindrical portion and a conical portion, which is a frustum of a cone, extending from one end of the cylindrical portion to provide the angled, flat surface 101.

The weight 100 on the front end of the hold down plate 96 insures that the first edge 102' of the package 14 remains in engagement with the beveled, flat surface 101 of the cutting wheel 102 during advancement of the package 14 past the cutting wheel 102. This results in cutting the entire length of a first edge of the envelope 11 (see FIG. 4) along the first edge 102' (see FIG. 5) of the package 14 riding on the beveled, flat surface 101 of the cutting wheel 102.

The cutting wheel 102 is continuously driven by a motor 103 through the cutting wheel 102 being mounted on a shaft 104 of the motor 103. The motor 103 has its enlarged bottom 104A attached to a spacer 104B, which is supported on a base plate 104C. The base plate 104C is secured to the tube 29 of the frame 23 and a square shape tube 104D, which is the same as the tube 29 and extends substantially perpendicular to the tube 29. One suitable example of the motor 103 is a three phase motor having a speed of 3450 RPM and sold by Baldor.

Figure 7:
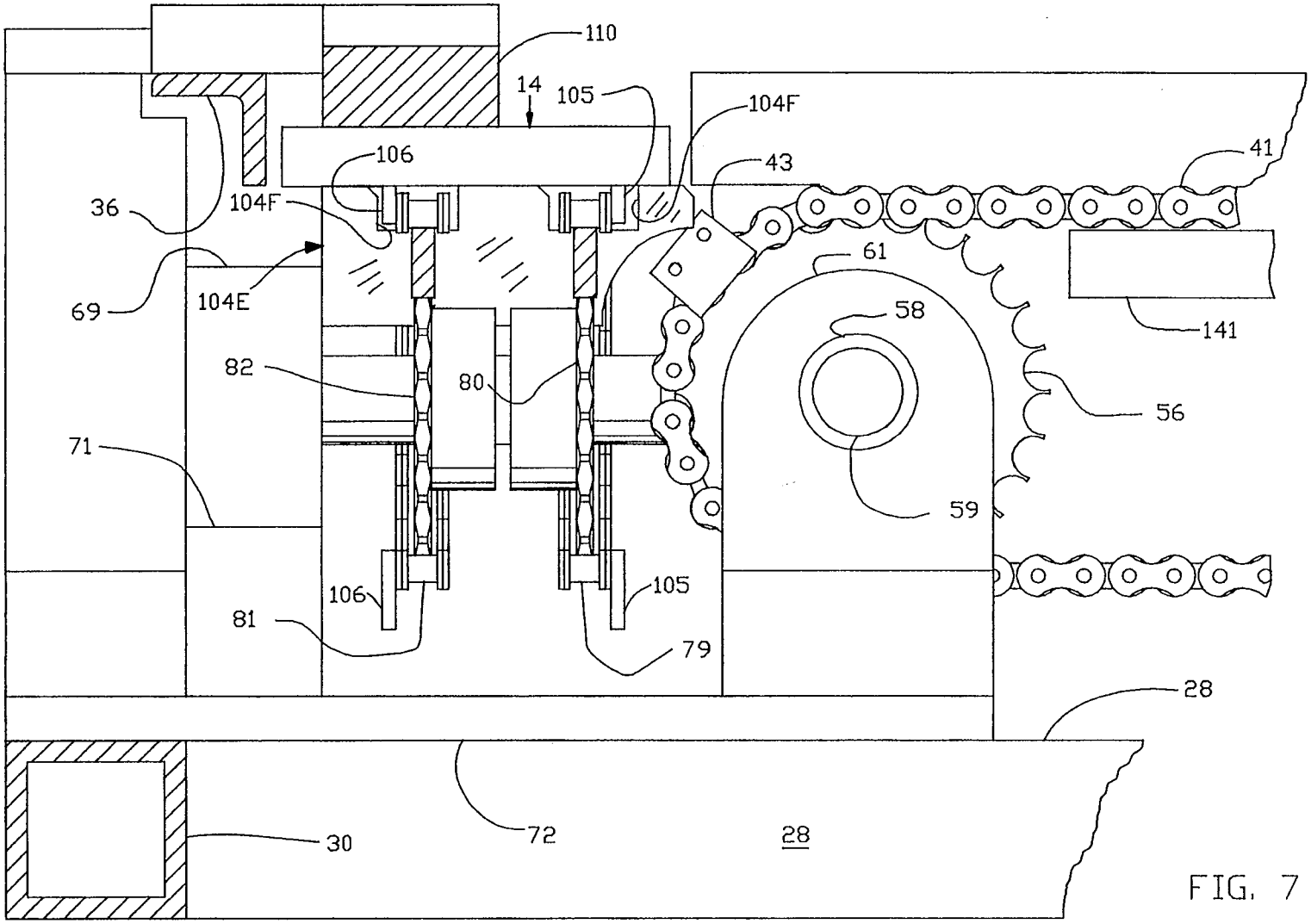
FIG. 7 is a fragmentary elevational view of a portion of the apparatus of FIG. 1B showing an arrangement for changing the direction of travel of the container and the sealed envelope and taken along line 7—7 of FIG. 1B.

After the package 14 has been advanced past the cutting wheel 102, the package 14 is advanced by the lugs 43 and 44 on the chains 41 and 42, respectively, to the position shown in FIG. 7 at which the lugs 43 and 44 (see FIG. 5) have ceased to engage the package 14 with the package 14 resting on a transfer block 104E (see FIG. 7). This ceasing of engagement of the lugs 43 and 44 with the package 14 is shown for the lug 43 in FIG. 7; this disengagement stops movement of the package 14 in a first direction.

The transfer block 104E supports the package 14 to prevent the package 14 from falling between the chains 79 and 81. The transfer block 104E has a pair of substantially parallel grooves 104F in its upper surface to receive the chains 79 and 81 and a pair of substantially parallel grooves 104G (see FIG. 1B) in one of its sides to receive the lugs 43 and 44. As shown in FIG. 7, the grooves 104F also receive lugs 105 and 106 on the chains 79 and 81, respectively.

With the package 14 resting on the transfer block 104E, the lugs 105 and 106 on the chains 79 and 81, respectively, engage an edge of the package 14 perpendicular to the edge previously engaged by the lugs 43 and 44 (see FIG. 5). This engaged edge of the package 14 is the edge parallel to the first edge 102' (see FIG. 4) of the package 14 having the cut first edge of the envelope 11. This results in the package 14 (see FIG. 7) being moved in a second direction perpendicular to the first direction in which it previously had been moved.

The lugs 105 and 106 are mounted on the chains 79 and 81, respectively, at predetermined spaced intervals greater than the dimension of the package 14 in the second direction of travel. Each of the lugs 105 is aligned with one of the lugs 106.

As the package 14 is advanced in the second direction, the package 14 passes beneath a pivotally mounted hold down plate 110 (see FIG. 1B), which is the same as the hold down plate 96 and mounted in the same manner. As the package 14 is advanced beneath the hold down plate 110, a second edge 110' (see FIG. 4) of the package 14 engages a beveled or angled, flat surface 111 (see FIG. 1B) of a cutting wheel 112, which is the same as the cutting wheel 102. The cutting wheel 112 is continuously driven by a motor 113, which is the same as the motor 103 and supported in the same manner as the motor 103.

This engagement of the second edge 110' (see FIG. 4) of the package 14 with the beveled, flat surface 111 (see FIG. 1B) of the cutting wheel 112 causes tilting of the package 14 so that the second edge 110' (see FIG. 4) of the package 14 rides on the beveled flat surface 111 (see FIG. 1B) in the same manner as the first edge 102' (see FIG. 5) of the package 14 previously rode on the beveled, flat surface 101 of the cutting wheel 102 as shown in FIG. 5. This results in cutting the entire length of a second edge of the envelope 11 (see FIG. 4) of the package 14 along the second edge 110' of the package 14 riding on the beveled, flat surface 111 (see FIG. 1B) of the cutting wheel 112.

The package 14 then advances beneath a pivotally mounted hold down plate 114 (see FIG. 1B) on the opposite side of the package 14. The hold down plate 114 is the same as the hold down plate 96 and is supported in the same manner as the hold down plate 96. As the package 14 is advanced beneath the hold down plate 114, a third edge 114' (see FIG. 4), which is substantially parallel to the second edge 110', of the package 14 engages a beveled or angled, flat surface 115 (see FIG. 1B) of a cutting wheel 116, which is the same as the cutting wheel 102. The cutting wheel 116 is continuously driven by a motor 117, which is the same as the motor 103 and supported in the same manner as the motor 103.

This engagement of the third edge 114' (see FIG. 4) of the package 14 with the beveled, flat surface 115 (see FIG. 1B) of the wheel 116 causes tilting of the package 14 so that the third edge 114' (see FIG. 4) of the package 14 rides on the beveled, flat surface 115 (see FIG. 1B) of the cutting wheel 116 in the same manner as the first edge 102' (see FIG. 5) of the package 14 rode on the beveled flat surface 101 of the cutting wheel 102 as shown in FIG. 5. This results in cutting the entire length of a third edge of the envelope 11 (see FIG. 4) of the package 14 along the third edge 114' of the package 14 riding on the beveled, flat surface 115 (see FIG. 1B) of the cutting wheel 116.

As the package 14 is advancing past the cutting wheel 116, the bottom of the package 14 engages a resiliently biased pivotally mounted arm 118 of a normally open switch 119 to close it. The switch 119 is supported by a bracket 120, which extends upwardly from the tube 30 of the frame 23.

The switch 119 produces an electrical signal when it is closed to indicate that one of the packages 14 is at a specific location, namely, the location of the switch 119. Because of the predetermined longitudinal spacing between the lugs 105 on the chain 79 and the corresponding lugs 106 on the chain 81, the location of one of the packages 14 at the location of the switch 119 results in another of the packages 14 being positioned for movement by a pusher piston 121 (see FIG. 13) of an air cylinder 122. The air cylinder 122 is supported by a plate 123 extending between the guide rails 35 (see FIG. 1A) and 36 and supported thereby.

When the switch 119 (see FIG. 1B) has the arm 118 engaged by the bottom of one of the packages 14, the package 14 is positioned beneath an elongated rod 124 (see FIG. 9), which extends from a plate 124'. The plate 124' is mounted on the bottom of a plate 125 (see FIG. 8) extending between the guide rails 35 and 36 and supported thereby.

The elongated rod 124 also is supported by a plate 126 (see FIG. 1A), which extends between the tubes 29 and 30 and is supported by one of the two legs 31 (see FIG. 9) extending upwardly from the tube 29 (see FIG. 1A) and the intermediate leg 32 (see FIG. 9) extending upwardly from the tube 30 (see FIG. 1A). The ends of the plate 126 are connected by screws 127 to the legs 31 (see FIG. 9) and 32 and by screws 128 (see FIG. 1A) to the guide rails 35 and 36.

The plates 124' and 126 also support a second elongated rod 129. The second elongated rod 129 terminates prior to the cutting wheel 116 (see FIG. 1B) so that the rod 129 does not act on the package 14 until the package 14 has ceased to be engaged with the beveled edge 115 of the cutting wheel 116. The elongated rods 124 (see FIG. 9) and 129 are retained within passages in the plates 124' and 126 (see FIG. 1A) by set screws (not shown).

As the package 14 is advanced underneath the elongated rods 124 and 129, the package 14 has its edge adjacent the guide rail 36 engage a wiper 130 (see FIG. 8) to retard the motion of the envelope 11 (see FIG. 4) with the container 12 so that removal of the envelope 11 from the container 12 can begin. The wiper 130 (see FIG. 8) includes a rubber element 130A retained on a metal support 130B by a clamp 130C, which has two screws passing through the rubber element 130A and into the metal support 130B to secure the rubber element 130A and the clamp 130C to the metal support 130B. The metal support 130B has a portion 130D engaging the end of the rubber element 130A remote from the clamp 130C.

Figure 10:
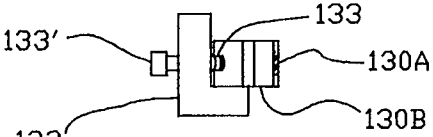
FIG. 10 is an end elevational view of a wiper of FIG. 8 and taken along line 10—10 of FIG. 8.
Figure 8:
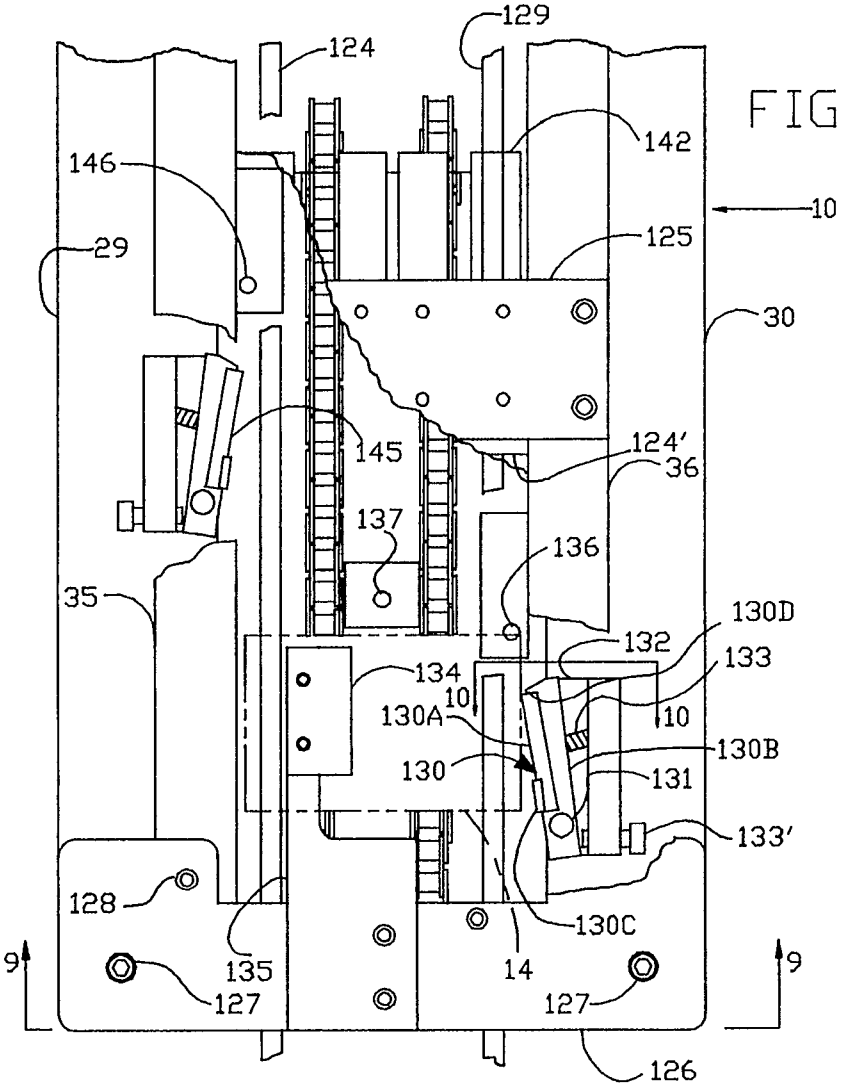
FIG. 8 is a fragmentary top plan view of a portion of the apparatus of FIG. 1A and showing means for partially removing the cut envelope from the container after cutting of the three edges of the envelope has been completed.

The metal support 130B is pivotally mounted by a pivot pin 131 on an L-shaped metal support 132 (see FIG. 10), which is mounted on the guide rail 36 (see FIG. 8). A spring 133, which has its ends supported in counterbores in the metal support 130B and the L-shaped support 132, continuously urges the rubber element 130A of the wiper 130 into the position in which it engages the package 14 as shown in FIG. 8. An adjusting screw 133' is supported within the L-shaped support 132 to act on the support 130B to vary the force exerted on the package 14 by the spring 133.

As the package 14 is passing the wiper 130, a switch 134, which is supported on a plate 135 (see FIG. 1A) supported by the plate 126, has a downwardly extending resiliently biased arm (not shown) engaged by the top of the package 14 (see FIG. 8). This closes the switch 134 to transmit an electrical signal for causing pressurized air to be supplied from a pressurized air source (not shown) through nozzles 136 and 137. The pressurized air through the nozzles 136 and 137 is turned off by a timer a predetermined period of time after the switch 134 is closed. The pressurized air further partially removes the cut envelope 11 (see FIG. 4) from the container 12.

The nozzle 136 (see FIG. 8) is supported by the guide rail 36. The nozzle 137 is supported by chain supports 138 (see FIG. 9) and 139 for the chains 79 and 81, respectively. The chain supports 138 and 139 are attached by screws (not shown) to a block 139A secured by screws 139B to a first chain support bracket 140, which is mounted on one of the two legs 31 and the intermediate leg 32. The chain supports 138 and 139 also are supported on a second chain support bracket (not shown), which is mounted on the other of the two legs 31 and one of the end legs 32 in the same manner as the first chain support bracket 140 is mounted.

The chains 41 (see FIG. 5) and 42 are similarly supported by chain supports 141 and 142. The chain supports 141 and 142 are attached by screws (not shown) to a block 142' (see FIG. 2) secured by screws (not shown) to a first chain support bracket 143, which is mounted on one of the legs 25 (see FIG. 3) and one of the legs 26. The chain supports 141 (see FIG. 5) and 142 also are attached by screws (not shown) to a block 143A secured by screws 143B to a second chain support bracket 144, which is mounted on the other of the legs 25 (see FIG. 3) and the other of the legs 26 in the same manner as the second chain support bracket (not shown) for the chain supports 138 (see FIG. 9) and 139 is mounted on the other of the legs 31 and another of the legs 32.

As the package 14 (see FIG. 8) advances, the package 14 has its edge closest to the guide rail 35 engage a second wiper 145, which is the same as the wiper 130. When the downwardly extending arm of the switch 134 returns to its initial position because it is no longer engaged by the package 14 (see FIG. 8), pressurized air is supplied through a nozzle 146, which is supported by the guide rail 35, to further partially remove the envelope 11 (see FIG. 4) from the container 12. The pressurized air through the nozzle 146 (see FIG. 8) is turned off by a timer a predetermined period of time after the switch 134 returns to its initial position.

Figure 11:
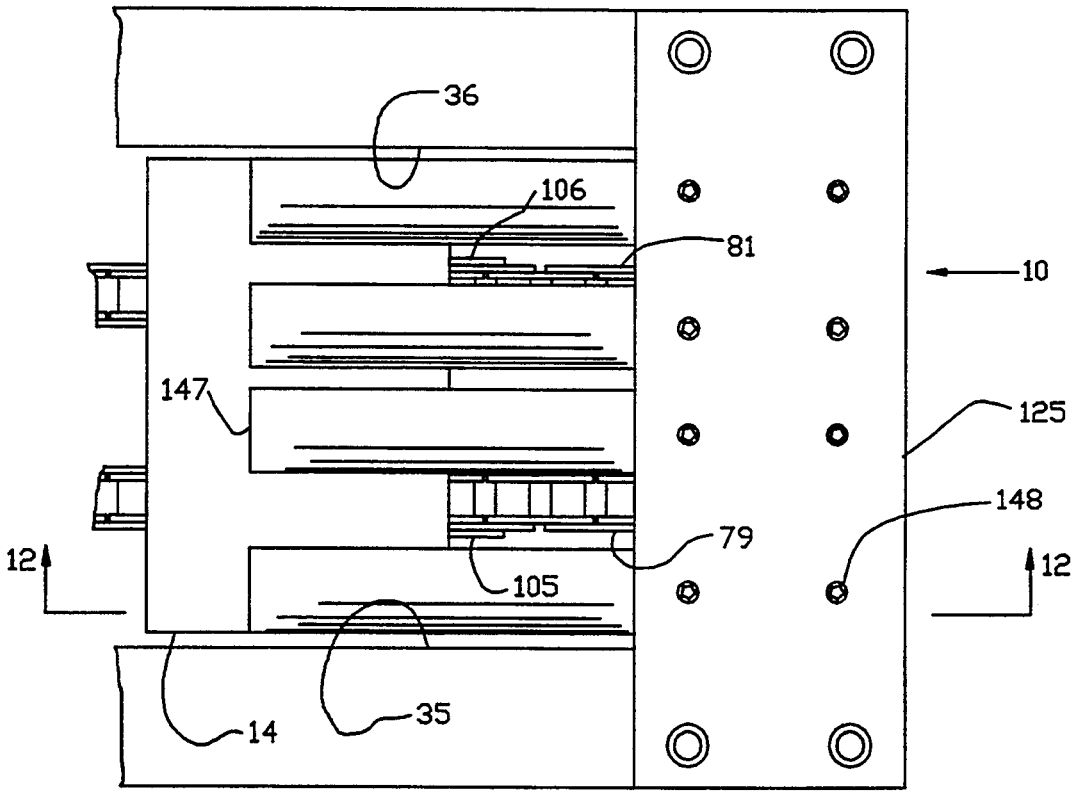
FIG. 11 is a fragmentary top plan view of a portion of the apparatus of FIG. 1A showing an arrangement of flexible tubes for further removing the cut envelope from the container after air pressure has been applied to the cut envelope.

After the package 14 has advanced beyond the wiper 145, it passes beneath four hollow flexible tubes 147 (see FIG. 11), which are supported by the plate 125 and extend substantially horizontally therefrom. Each of the hollow flexible tubes 147 is formed of polyethylene.

Figure 12:
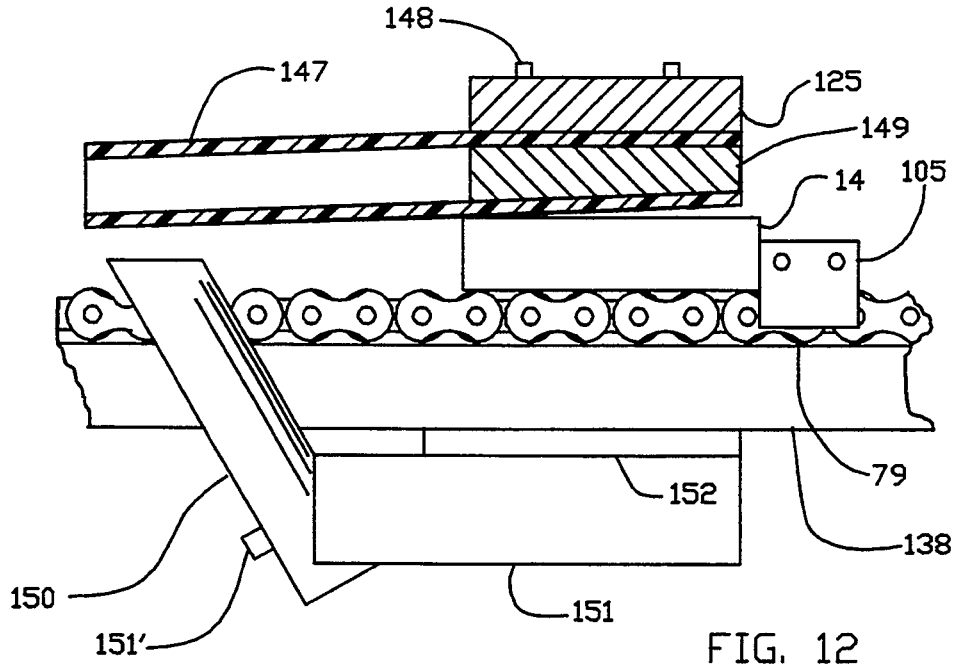
FIG. 12 is a fragmentary sectional view, partly in elevation, showing one of the upper flexible tubes and a lower flexible tube and taken along line 12—12 of FIG. 11.

As shown in FIG. 12, each of the flexible tubes 147 is secured to the plate 125 by a pair of screws 148 extending into a metal cylindrical slug 149 within the tube 147. When viewed from the right end in FIG. 12, the slug 149 has a flat milled surface at the 12 o'clock position in its circular cross section for a portion of the length of the slug 149. When the screws 148 are tightened, this causes the tube 147 to bend downwardly slightly to rub across the top of the package 14 as the package 14 is advanced to the left in FIG. 12 to aid in removing the cut envelope 11 (see FIG. 4) from the container 12.

In addition to the four tubes 147 (see FIG. 12) above the package 14, there is one hollow flexible tube 150, which is the same material as the tubes 147, beneath the package 14. This rubs along the bottom of the package 14 to also aid in removing the cut envelope 11 (see FIG. 4) from the container 12 of the package 14.

The tube 150 (see FIG. 12) is retained within a groove (not shown) in a U-shaped block 151 by a screw 151' extending through a first hole (not shown) in the tube 150, a passage (not shown) in a metal cylindrical slug (not shown), which is the same as the metal cylindrical slug 149 except that it does not have a milled surface, a second hole (not shown) in the tube 150 diametrically opposite the first hole, and into a tapped hole (not shown) in the block 151. The block 151 is attached to a support 152, which is disposed between the chain supports 138 and 139 (see FIG. 9) and fixed thereto.

After passing between the tubes 147 (see FIG. 11) and 150 (see FIG. 12), the package 14 passes beneath hold down pads 153 (see FIG. 1A) and 154, which are supported by the guide rails 35 and 36, respectively. The hold down pads 153 and 154 prevent the package 14 from moving off of the guide rails 35 and 36, respectively, due to the tubes 147 (see FIG. 12) and 150 acting on the package 14.

Figure 13:
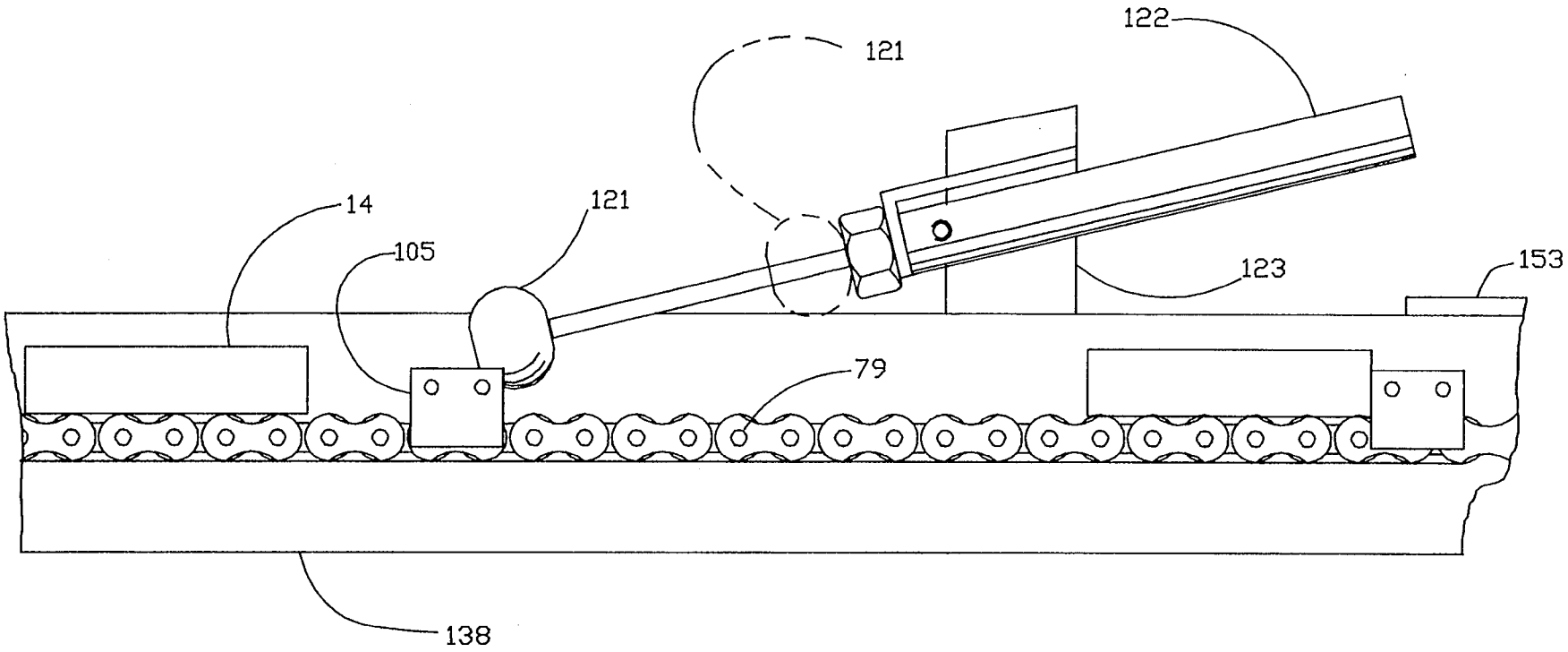
FIG. 13 is a fragmentary side elevational view of a portion of the apparatus of FIG. 1A showing a pusher piston of an air cylinder extended to advance the container and the envelope to a vacuum area.

As shown in FIG. 1A, when one of the packages 14 is activating the switch 134, another of the packages 14 is positioned for engagement by the piston pusher 121 of the air cylinder 122. Thus, closing of the switch 134 also causes extension of the piston pusher 121 from its retracted position (shown in phantom in FIG. 13) to move the package 14 away from the lugs 105 and 106 (see FIG. 1A) as shown in FIG. 13 for the lug 105. This engagement of the piston pusher 121 occurs prior to the position shown in FIG. 13 since it occurs when the upper back edge of the package 14 is engaged by extension of the piston pusher 121 to the solid line position of FIG. 13.

Figure 14:
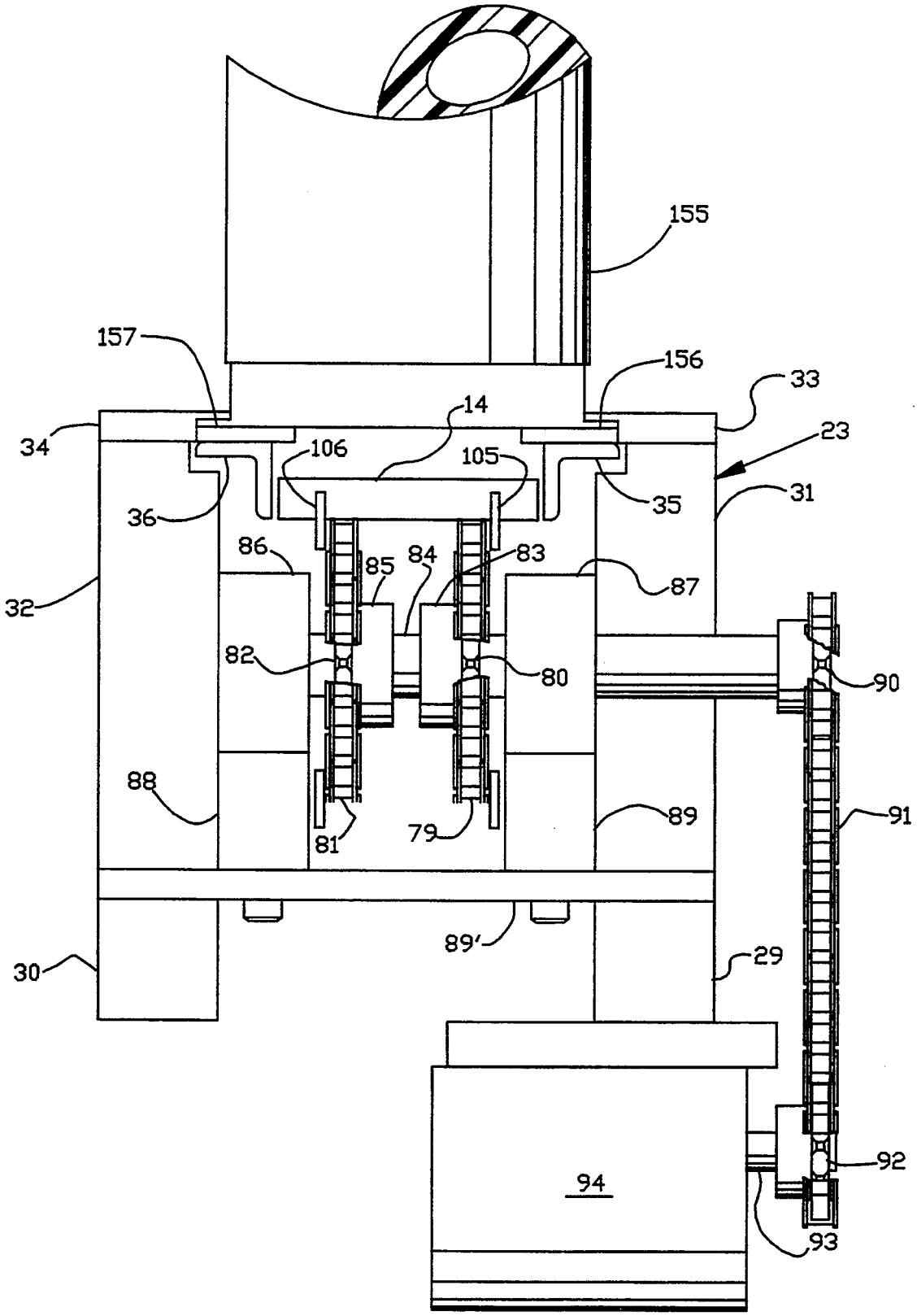
FIG. 14 is an end elevational view of the apparatus of FIG. 1A showing a vacuum arrangement to remove a cut envelope from the container that the cut envelope enclosed and taken along line 14—14 of FIG. 1A.

The piston pusher 121 advances the package 14 beneath an enlarged hollow tube 155 (see FIG. 14). The tube 155 has a vacuum applied thereto to cause the cut envelope 11 (see FIG. 4) to be withdrawn completely from the container 12 of the package 14. Because neither the piston pusher 121 (see FIG. 13) nor the lugs 105 and 106 (see FIG. 9) are engaging the package 14 when the package 14 is disposed beneath the tube 155 (see FIG. 1A), vacuum within the tube 155 can complete removal of the cut envelope 11 (see FIG. 4) from the container 12.

The vacuum also could tilt the package 14 from the guide rails 35 (see FIG. 1A) and 36. To prevent this, hold down pads 156 and 157 are supported on the guide rails 35 and 36. Each of the hold down pads 156 and 157 extends from where the package 14 first enters beneath the tube 155 until the package 14 exits therefrom as shown in FIG. 1A.

With the container 12 (see FIG. 4) having the cut envelope 11 removed therefrom, the package 14, which now includes only the container 12 and the tape therein, is again usually engaged at its rear edge by the lugs 105 (see FIG. 1A) and 106 to advance the package 14 away from the vacuum tube 155 although the package 14 may advance away from the vacuum tube 155 solely by riding on the chains 79 and 81 without being engaged by the lugs 105 and 106.

The package 14 is continued to be advanced to the left in FIG. 1A until the package 14 is advanced beyond the ends of the sprockets 80 (see FIG. 14) and 82. At this time, the package 14 falls by gravity into a magazine 158 (see FIG. 17) in which the packages 14 (see FIG. 4) are stacked.

The magazine 158 (see FIG. 17) includes an inclined wall 159 along which each of the packages 14 (see FIG. 1A) slides by gravity from the chains 79 and 81. Each of the packages 14 moves along the inclined wall 159 into a rectangular shaped opening 160, which is defined by substantially vertical walls 161, 162, 163, 164, and 165 of the magazine 158. A conveyor 166 is disposed beneath the bottom of the magazine 158 to receive each of the packages 14 (see FIG. 4) as the package 14 exits from the bottom of the rectangular shaped opening 160 (see FIG. 17) of the magazine 158.

The vertical wall 161, which has the inclined wall 159 attached to its upper end, has a mounting bracket 167 secured to its outer surface to support a sensor 168. One suitable example of the sensor 168 is a photoelectric switch sold by Omron as model 3XCO1. The sensor 168 has its eye exposed to each of the packages 14 (see FIG. 4) passing through the magazine 158 (see FIG. 17) by an enlarged opening 169 in the wall 161 and an opening 170 in the mounting bracket 167.

If the packages 14 (see FIG. 4) should stack up within the rectangular shaped opening 160 (see FIG. 17) in the magazine 158 because of the conveyor 166 being stopped, for example, the sensor 168 will have its beam of light broken. Because each of the packages 14 (see FIG. 4) passes the enlarged opening 169 (see FIG. 17) in the vertical wall 161, each of the packages 14 (see FIG. 4) interrupts the beam of light momentarily during its movement from the inclined wall 159 (see FIG. 17) to the conveyor 166. Accordingly, the beam of light from the sensor 168 must be interrupted for a predetermined period of time before operation of the apparatus 10 (see FIG. 1A) is stopped by inactivating the motor 94. When this predetermined period of time for interruption of the beam of light of the sensor 168 (see FIG. 17) is exceeded, this indicates that the packages 14 (see FIG. 1A) are stacked within the rectangular shaped opening 160 (see FIG. 17), and the motor 94 (see FIG. 1A) must be stopped.

Figure 17:
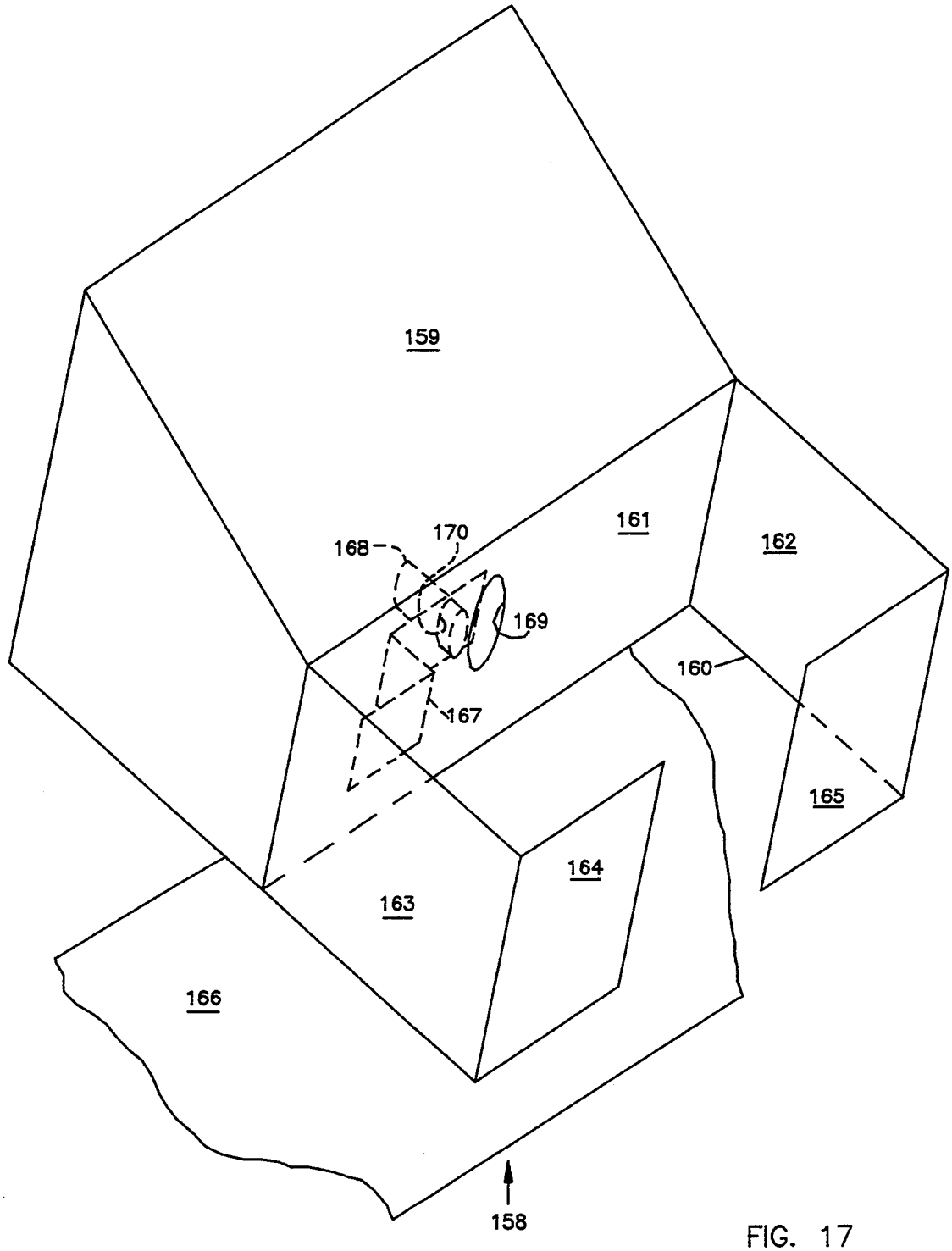
FIG. 17 is a perspective view of a magazine for receiving each of the containers after the cut envelope has been removed from the container.

The vertical walls 164 (see FIG. 17) and 165 are spaced from each other to enable the packages 14 (see FIG. 4) to be lifted therefrom if they become stacked within the rectangular shaped opening 160 (see FIG. 17). This spacing between the vertical walls 164 and 165 also prevents any deflection of the beam of light as could occur if the walls 164 and 165 were not spaced from each other.

Figure 18:
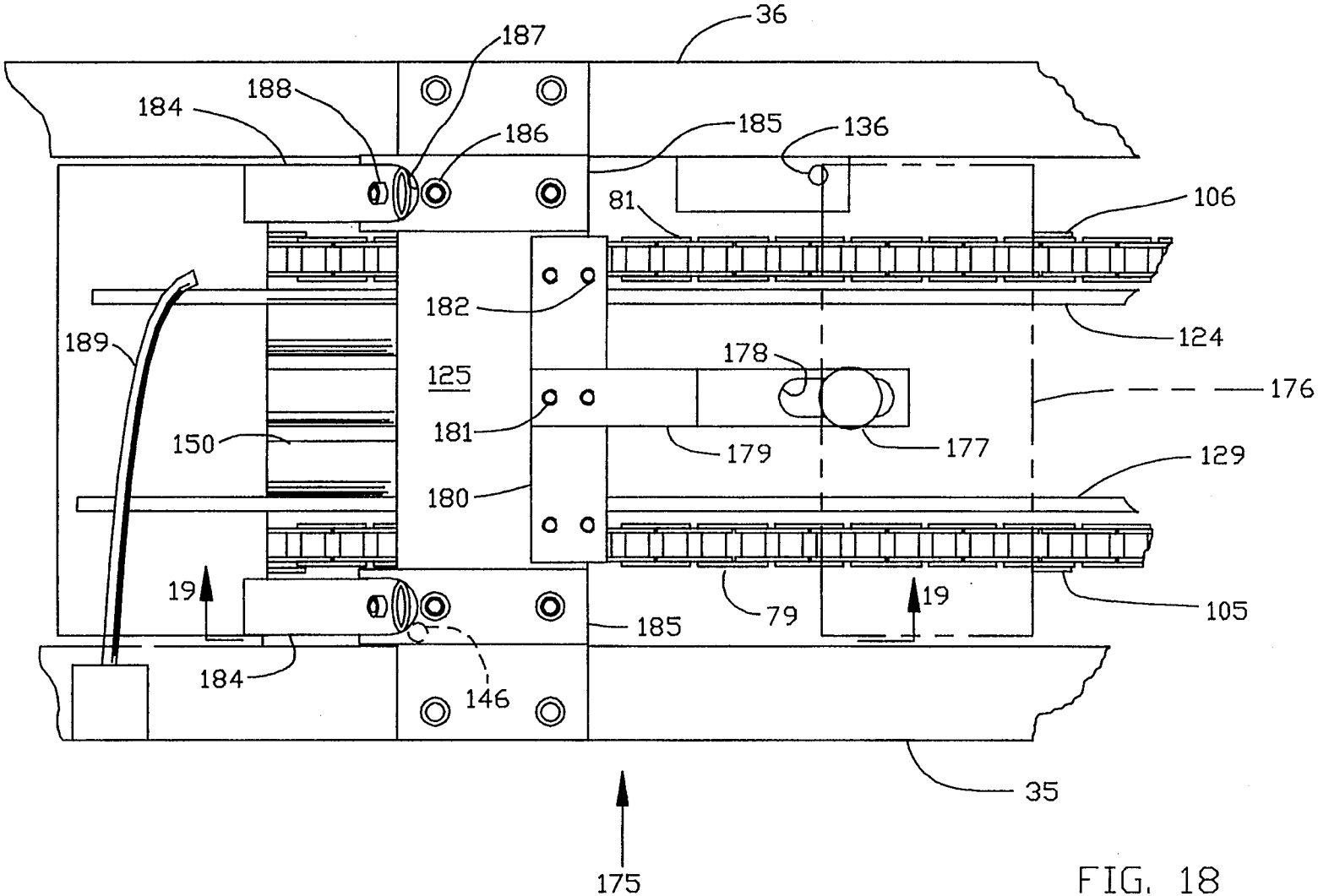
FIG. 18 is a fragmentary top plan view of a portion of another embodiment of the envelope removal apparatus of the present invention.
Figure 19:
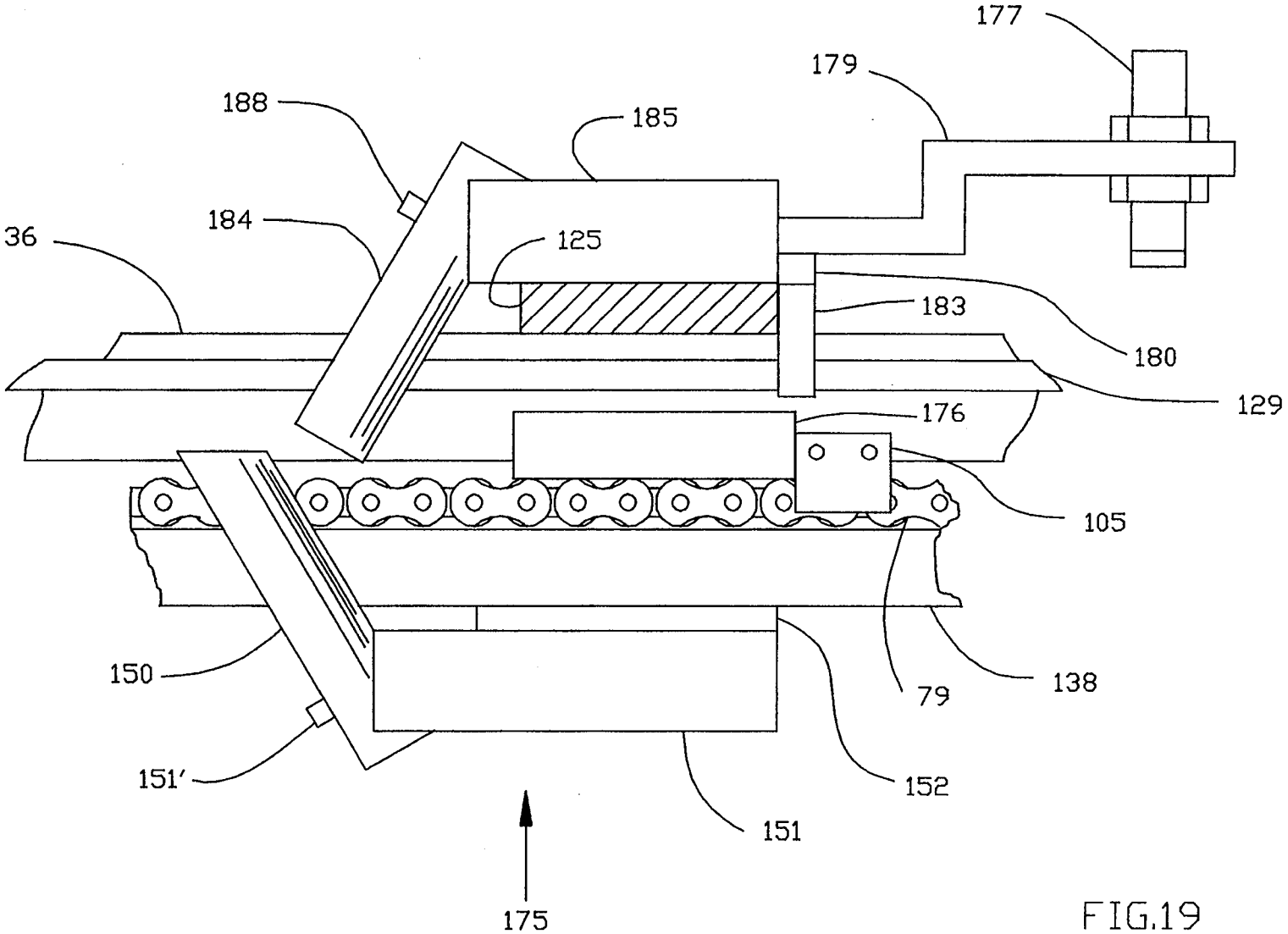
FIG. 19 is a fragmentary side elevational view, partly in section, of the apparatus of FIG. 18 and taken along line 19—19 of FIG. 18.

Referring to FIGS. 18 and 19, there is shown an apparatus 175 for use when the container 12 (see FIG. 4) contains a video tape rather than an audio tape. Thus, the apparatus 175 (see FIG. 18) transports packages 176. Each of the packages 176 is formed by the container 12 (see FIG. 4) having a video tape therein and the container 12 being enclosed by the sealed envelope 11.

The apparatus 175 (see FIG. 18) is the same as the apparatus 10 (see FIG. 1A) except for the differences discussed hereinafter as shown in FIGS. 18 and 19. The apparatus 175 does not utilize the wipers 130 (see FIG. 8) and 145.

The lugs 105 (see FIG. 18) and 106 on the chains 79 and 81, respectively, of the apparatus 175 are spaced longitudinally further apart than in the apparatus 10 (see FIG. 1A) because the package 176 is larger than the package 14 (see FIG. 1A) due to a video tape being larger than an audio tape. The chains 79 (see FIG. 18) and 81 of the apparatus 175 are spaced further apart than in the apparatus 10 (see FIG. 1A) to accommodate the increased length of the package 176 (see FIG. 18). The chains 41 (see FIG. 1B) and 42 and the lugs 43 and 44 would be similarly changed in size as would the magazine 15.

The switches 119 and 134 (see FIG. 1A) of the apparatus 10 are replaced by a single sensor 177 (see FIG. 18) in the apparatus 175. The sensor 177, which is the same as the sensor 168 (see FIG. 17), is mounted within a slot 178 (see FIG. 18) in a stepped mounting bracket 179, which is secured to a plate 180 by screws 181. The plate 180 rests on top of the plate 125 and is secured by the screws 181 and screws 182 to the plate 125, which is supported by the rails 35 and 36.

Figure 9:
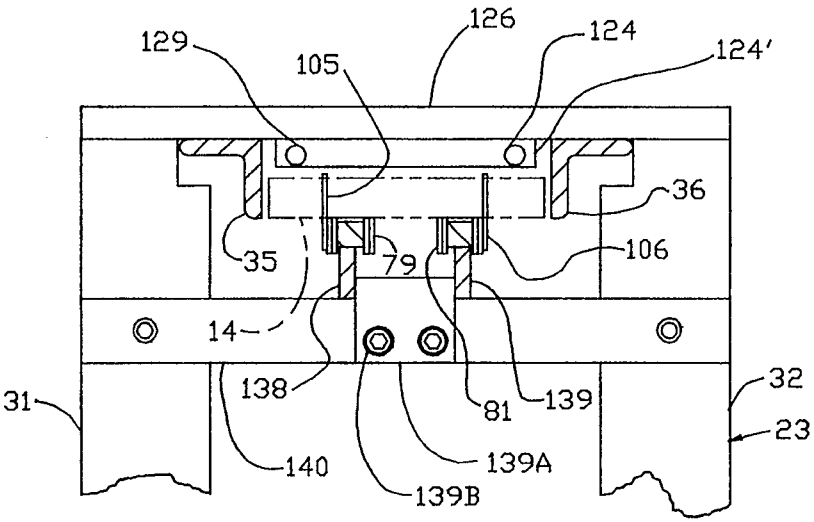
FIG. 9 is a fragmentary elevational view, partly in section, of the apparatus of FIG. 8 and taken along line 9—9 of FIG. 8.

The elongated rods 124 and 129 are supported by a plate 183 (see FIG. 19) rather than the plate 124' (see FIG. 9). Each of the elongated rods 124 (see FIG. 18) and 129 is retained within a hole (not shown) in the plate 183 (see FIG. 19) by a set screw (not shown). The elongated rods 124' (see FIG. 1A) and 129 also are supported by the plate 126 as previously described for the apparatus 10.

The apparatus 175 (see FIG. 18) has three of the hollow flexible tubes 150 rather than the one hollow flexible tube 150 (see FIG. 12) of the apparatus 10. The three flexible hollow tubes 150 (see FIG. 18) of the apparatus 175 rub along the bottom of the package 176 to aid in removing the cut envelope 11 (see FIG. 4) of the package 176 (see FIG. 18) from the container 12 (see FIG. 4) of the package 176 (see FIG. 18).

Instead of using the four flexible tubes 147 (see FIG. 11) of the apparatus 10, two hollow flexible tubes 184 (see FIG. 18) are employed to rub across the top of each of the packages 176 as the package 176 is advanced to the left in FIG. 19 to aid in removing the cut envelope 11 (see FIG. 4) of the package 176 (see FIG. 19) from the container 12 (see FIG. 4) of the package 176 (see FIG. 19). Each of the tubes 184 is supported by a block 185, which is secured to the plate 125 by screws 186 (see FIG. 18).

Each of the blocks 185 has a groove 187 within which is disposed one of the flexible tubes 184. A screw 188 extends through a first hole (not shown) in the tube 184, a passage (not shown) in a metal cylindrical slug (not shown), which is the same as the metal cylindrical slug 149 (see FIG. 12) except that it does not have a milled surface, a second hole (not shown) in the tube 184 (see FIG. 18) diametrically opposite the first hole, and into a tapped hole (not shown) in the block 185. The two flexible tubes 184 are disposed exterior of the chains 79 and 81.

While the apparatus 175 does not have the nozzle 137 (see FIG. 8) of the apparatus 10, the apparatus 175 (see FIG. 18) has pressurized air supplied through a hose 189 to blow upwardly against the cut envelope 11 (see FIG. 4) of the package 176 (see FIG. 18) on one side of the container 12 (see FIG. 4) of the package 176 (see FIG. 18). The apparatus 175 also has pressurized air supplied through the nozzles 136 and 146 with the air to the nozzle 146 and the hose 189 being supplied at the same time.

Figure 20:
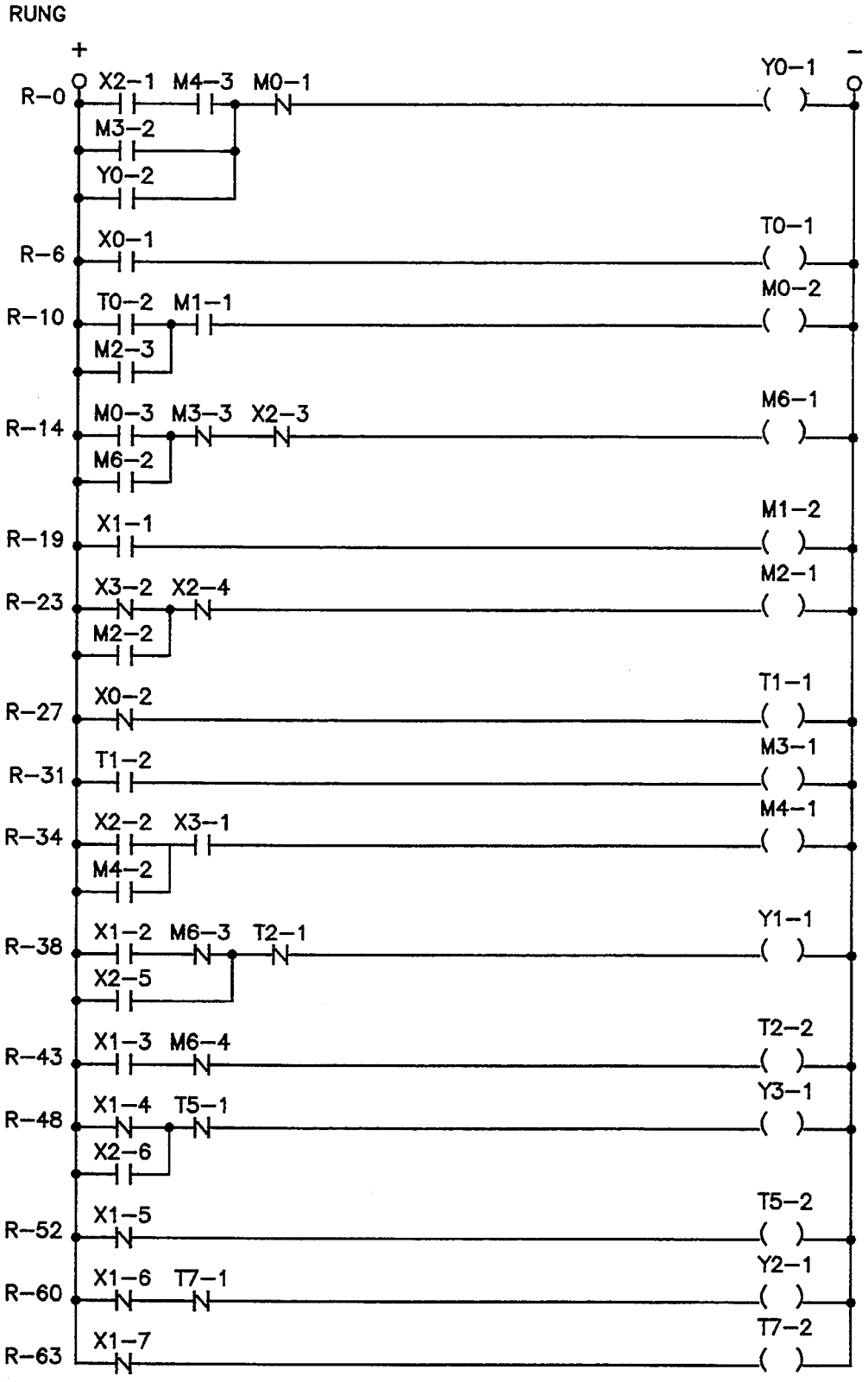
FIG. 20 is a ladder logic diagram of signals produced by a programmable controller for controlling operation of the apparatus of the present invention.

While the apparatus 175 may be controlled in any manner, a Mitsubishi programmable controller, MELSEC F0 series, is preferably used. FIG. 20 is a ladder logic diagram using the Mitsubishi programmable controller with the apparatus 175 (see FIG. 18) in which the package 176 contains a video tape and only the single sensor 177 is used for sensing the position of the package 175 at a single position rather than the two sensing switches 119 (see FIG. 1B) and 134 (see FIG. 1A) of the apparatus 10.

When the apparatus 175 (see FIG. 18) is to be started, a start push button (not shown) is manually activated to cause energization of the motor 94 (see FIG. 1A). Activation of the start push button causes a normally open contact X2-1 (see FIG. 20) at rung R-0 to close. When the manual start push button is closed, a normally open contact X2-2 at rung R-34 also is closed. Since a contact X3-1 of a stop push button is normally closed and opened only when it is desired to manually stop the apparatus 175 (see FIG. 18), a coil M4-1 (see FIG. 20) at rung R-34 is energized. This energization of the coil M4-1 closes a normally open contact M4-2 to latch the coil M4-1 in its energized state.

The energization of the coil M4-1 causes a normally open contact M4-3 at rung R-0 to close. With a contact M0-1 normally closed, a coil Y0-1 is turned on. Turning on of the coil Y0-1 applies a voltage to a solenoid (not shown) to start the motor 94 (see FIG. 1A) to begin automatic operation of the apparatus 175 (see FIG. 18). When the coil Y0-1 (see FIG. 20) is energized, a normally open contact Y0-2 is closed to latch the coil Y0-1 in its activated position so that the coil Y0-1 remains energized after release of the manual start push button results in the contact X2-1 opening.

The magazine 158 (see FIG. 17) receives each of the packages 176 (see FIG. 18) after the cut envelope 11 (see FIG. 4) has been removed from the container 12 of the package 176 (see FIG. 18). The sensor 168 (see FIG. 17) of the magazine 158 causes a normally open contact X0-1 (see FIG. 20) at rung R-6 to close each time that one of the packages 176 (see FIG. 18) passes the enlarged opening 169 (see FIG. 17) in the vertical wall 161 of the magazine 158.

Closing of the contact X0-1 (see FIG. 20) at rung R-6 starts a timer T0-1. If the contact X0-1 is closed for one second, this indicates that one of the packages 176 (see FIG. 18) is stopped in front of the sensor 168 (see FIG. 17) whereby the magazine 158 is full. When the magazine 158 is full, it is desired to stop the motor 94 (see FIG. 1A).

If the timer T0-1 (see FIG. 20) at rung R-6 receives a signal for one second, it turns on to close a normally open contact T0-2 at rung R-10. If a normally open contact M1-1 is closed when the normally open contact T0-2 closes, a coil M0-2 is energized to open the normally closed contact M0-1 at rung R-0 whereby the coil Y0-1 is opened to inactivate the motor 94 (see FIG. 1A).

The coil M0-2 (see FIG. 20) at rung R-10 is energized only when the normally open contact T0-2 is closed and the normally open contact M1-1 is closed. The normally open contact M1-1 is closed when none of the packages 176 (see FIG. 18) is touching any of the cutting wheels 102 (see FIG. 1B), 112, and 116. This is ascertained by the sensor 177 (see FIG. 18) sensing one of the packages 176 at the location of the sensor 177. That is, when one of the packages 176 is at the sensor 177, none of the packages 176 is touching any of the cutting wheels 102 (see FIG. 1B), 112, and 116.

Thus, closing of the normally open contact Xl-1 (see FIG. 20) at rung R-19 by the sensor 177 (see FIG. 18) sensing one of the packages 176 results in a pulse being provided from a coil M1-2 at rung R-19 to close the normally open contact M1-1 at rung R-10. This closing of the contact M1-1 energizes the coil M0-2 to open the normally closed contact M0-1 at rung R-0 so that the coil Y0-1 no longer applies a voltage to a solenoid to maintain the motor 94 (see FIG. 1A) energized whereby all movement of the packages 176 (see FIG. 18) is stopped. This insures that none of the packages 176 has the envelope 11 (see FIG. 4) being cut at the time that advancement of the packages 176 (see FIG. 18) is stopped.

With the motor 94 (see FIG. 1A) automatically stopped because of the magazine 158 (see FIG. 17) being full, the motor 94 (see FIG. 1A) is automatically started again when the sensor 168 (see FIG. 17) at the magazine 158 is off for 0.5 second. This is because the sensor 168 causes a contact X0-2 (see FIG. 20) at rung R-27 to be closed when the sensor 168 (see FIG. 17) no longer senses the presence of the packages 176 (see FIG. 18) in the magazine 158 (see FIG. 17).

With the contact X0-2 (see FIG. 20) at rung R-27 closed for 0.5 second, a timer T1-1 closes a normally open contact T1-2 at rung R-31 to provide a pulse to a coil M3-1 whereby its normally open contact M3-2 at rung R-0 is closed. This closing of the contact M3-2 again starts the motor 94 (see FIG. 1A) by energizing the coil Y0-1 (see FIG. 20). The normally open contact M4-3 is still held closed by the coil M4-1 at rung R-34 because of its latch circuit through the contact M4-2 since the contact X3-1 is only opened when a manual push stop button is activated to stop the motor 94 (see FIG. 1A). Therefore, the motor 94 is again activated as soon as the magazine 158 (see FIG. 17) is no longer filled by the packages 176 (see FIG. 18) therein.

When the motor 94 (see FIG. 1A) is automatically stopped by energization of the coil M0-2 (see FIG. 20) at rung R-10 because of the magazine 158 (see FIG. 17) being full, a coil M6-1 (see FIG. 20) at rung R-14 is energized because a normally open contact M0-3 is closed by energization of the coil M0-2. A contact X2-3 at rung R-14 is normally closed except when the manual start push button is activated to start the motor 94 (see FIG. 1A), and a normally closed contact M3-3 (see FIG. 20) at rung R-14 is closed unless the coil M3-1 at rung R-31 is pulsed on. Therefore, when the normally open contact M0-3 at rung R-14 closes, the coil M6-1 is energized, and a normally open contact M6-2 closes to latch the coil M6-1 in its energized state.

The motor 94 (see FIG. 1A) also may be manually stopped by activating the stop push button to cause its contact X3-2 (see FIG. 20) at rung R-23 to close. Since a contact X2-4 is closed when the manual start push button is not activated, a coil M2-1 is energized. Energization of the coil M2-1 causes its normally open contact M2-2 to close whereby the coil M2-1 is latched in its energized state when the manual stop push button is released. The coil M2-1 will remain energized until the contact X2-4 is opened by manually closing the start push button to start the motor 94 (see FIG. 1A).

Energization of the coil M2-1 (see FIG. 20) at rung R-23 also closes a normally open contact M2-3 at rung R-10. If none of the packages 176 (see FIG. 18) is touching any of the cutting wheels 102 (see FIG. 1B), 112, and 116, then the contact Xl-1 at rung R-19 will be closed so that the coil M1-2 is pulsed to cause closing of the contact M1-1 at rung R-10 to energize the coil M0-2. Energization of the coil M0-2 opens the contact M0-1 at rung R-0 to deenergize the coil Y0-1 whereby the motor 94 (see FIG. 1A) is turned off. Thus, to manually stop advancement of the packages 176 (see FIG. 18), it is necessary that none of the packages 176 be engaging any of the cutting wheels 102 (see FIG. 1B), 112, and 116, and this is indicated by the contact X1-1 at rung R-19 being closed.

When the sensor 177 (see FIG. 18) senses the presence of one of the packages 176, it is desired to supply pressurized air through the nozzle 136. This is accomplished through an air valve solenoid (not shown) being energized to connect the source of pressurized air with the nozzle 136.

When the sensor 177 senses the presence of one of the packages 176, a contact X1-2 (see FIG. 20) at rung R-38 is closed. With a contact M6-3 of the coil M6-1 at rung R-14 being closed when the coil M6-1 is not energized and the coil M6-1 is only energized after the motor 94 (see FIG. 1A) is stopped, a coil Yi-1 (see FIG. 20) at rung R-38 is energized through a normally closed contact T2-1 of a timer T2-2 at rung R-43. Energization of the coil Y1-1 at rung R-38 causes activation of the air valve solenoid so that pressurized air is supplied through the nozzle 136 (see FIG. 18).

The timer T2-2 (see FIG. 20) at rung R-43 is turned on because of the package 176 (see FIG. 18) being at the sensor 177 so that a contact X1-3 (see FIG. 20) at rung R-43 is closed. A contact M6-4 of the coil M6-1 at rung R-14 is normally closed at this time so that the timer T2-2 at rung R-43 controls the length of time that pressurized air is supplied to the nozzle 136 (see FIG. 18) through opening its contact T2-1 (see FIG. 20) at rung R-38. Pressured air is supplied for 0.8 second.

When the package 176 (see FIG. 18) is no longer sensed by the sensor 177, the contacts X1-2 (see FIG. 20) at rung R-38 and X1-3 at rung R-43 open. The opening of the contact X1-3 results in the timer T2-2 shifting state so that the contact T2-1 of rung R-38 returns to its normally closed state.

When the motor 94 (see FIG. 1A) is again started after having been stopped with one of the packages 176 at the sensor 177 (see FIG. 18), starting of the motor 94 (see FIG. 1A) by closing the manual start push button results in a normally open contact X2-5 (see 20) at rung R-38 being closed to energize the coil YI-1 so that pressurized air is supplied through the nozzle 136 (see FIG. 18) when the motor 94 (see FIG. 1A) is started.

This insures that pressurized air is supplied for the short time period of 0.8 second under control of the timer T2-2 (see FIG. 20) at rung R-43 at the start of operation of the motor 94 (see FIG. 1A). This is in the event that the envelope 11 (see FIG. 4) of the package 176 (see FIG. 18) did not receive sufficient air pressure prior to stopping advancement of the package 176.

When one of the packages 176 passes the sensor 177, a contact X1-4 (see FIG. 20) of rung R-48 closes. Since a contact T5-1 of a timer T5-2 at rung R-52 is closed at the time that the contact X1-4 closes, a coil Y3-1 is activated to energize a second air solenoid valve to enable pressurized air to be supplied to the nozzle 146 (see FIG. 18) and the hose 189. Energization of the timer T5-2 (see FIG. 20) occurs when a contact X1-5 closes simultaneously with the contact X1-4 of rung R-48 due to one of the packages 176 (see FIG. 18) passing the sensor 177. Energization of the timer T5-2 (see FIG. 20) for 0.5 second opens the contact T5-1 at rung R-48 to deenergize the coil Y3-1 to stop supply of pressurized air to the nozzle 146 (see FIG. 18) and the hose 189.

When the motor 94 (see FIG. 1A) is started by manually pushing the start push button after having been stopped, a normally open contact X2-6 of the manual start push button at rung R-48 is closed to energize the coil Y3-1. The coil Y3-1 only remains energized for the short period of time that the manual start push button is held closed. This insures that pressurized air is supplied through the nozzle 146 (see FIG. 18) and the hose 189 if sufficient pressurized air was not supplied prior to the motor 94 (see FIG. 1A) being stopped.

When the sensor 177 (see FIG. 18) does not sense one of the packages 176 after having sensed one of the packages 176, contact X1-6 at rung R-60 and contact X1-7 at rung R-63 are closed. Closing of the contact X1-6 at rung R-60 energizes a coil Y2-1 because a contact T7-1 of a timer T7-2 is closed. Energization of the coil Y2-1 shifts a solenoid valve to cause pressurized air to be supplied to the air cylinder 122 (see FIG. 13) to extend the pusher piston 121 to cause it to advance the package 176 (see FIG. 18) away from the lugs 105 and 106. This advances the package 176 beneath the vacuum tube 155 (see FIG. 1A).

The timer T7-2 (see FIG. 20) of rung R-63 is energized when the contact X1-7 is simultaneously closed with the contact X1-6 at rung R-60. The timer T7-2 at rung R-63 opens the contact T7-1 at rung R-60 after 0.30 second to deenergize the coil Y2-1. Inactivation of the coil Y2-1 shifts the solenoid valve to cause retraction of the pusher piston 121 (see FIG. 13) into the air cylinder 122 to the phantom line position of FIG. 13.

The same control system may be employed with the apparatus 10 (see FIG. 1A) for controlling its operation as has been described for controlling the operation of the apparatus 175 (see FIG. 18). Of course, the programmable controller would have to be changed to have pressurized air supplied to the nozzles 136 (see FIG. 8) and 137 in response to activation of the switch 134 and supply of pressurized air to the nozzle 146 controlled by inactivation of the switch 134. The switch 119 (see FIG. 1B) controls movement of the pusher piston 121 (see FIG. 1A).

An advantage of this invention is that it reduces the cost of removing a sealed envelope or wrapper from a container by decreasing the number of required employees. Another advantage of this invention is that automatic removal of the envelope or wrapper from a container is accomplished without damaging the surfaces of the container. A further advantage of this invention is that it requires a relatively small floor area.

For purposes of exemplification, particular embodiments of the invention have been shown and described according to the best present understanding thereof. However, it will be apparent that changes and modifications in the arrangement and construction of the parts thereof may be resorted to without departing from the spirit and scope of the invention.

We claim:

1. An apparatus for removing a sealed envelope in one piece from at least one rectangular shaped container enclosed by the sealed envelope including:

first transport means for transporting at least one rectangular shaped container enclosed by a sealed envelope in a first direction from a first position to a second position;

first cutting means for cutting a first edge of the sealed envelope on a first side of the container during transport of the container by said first transport means from the first position to the second position;

second transport means for transporting the container in a second direction, substantially perpendicular to the first direction, from the second position to a third position;

second cutting means for cutting a second edge of the envelope on a second side of the container substantially perpendicular to the first side of the container during transport of the container by said second transport means from the second position to the third position; third cutting means for cutting a third edge of the envelope on a third side of the container substantially parallel to the second side of the container during transport of the container by said second transport means from the second position to the third position;

each of the first, second, and third cut edges of the envelope and a fourth edge of the envelope on a fourth side of the container and substantially parallel to the first side of the container being in the same plane and at least a portion of the fourth edge remaining attached to the rest of the envelope after cutting is completed so that the envelope remains one piece;

and removal means for removing the cut envelope in one piece from the container after said second and third cutting means have been effective.

2. The apparatus according to claim 1 in which said removal means includes force applying means for applying forces to a top and bottom of the cut envelope to partially remove the cut envelope from the container.

3. An apparatus for removing a sealed envelope from at least one rectangular shaped container enclosed by the sealed envelope including:

first cutting means for cutting an edge of a sealed envelope on a first side of a container;

second cutting means for cutting an edge of the envelope on a second side of the container substantially perpendicular to the first side of the container;

third cutting means for cutting an edge of the envelope on a third side of the container substantially parallel to the second side of the container;

first relative moving means for producing relative movement between the container and said first cutting means to enable said first cutting means to cut the edge of the envelope on the first side of the container;

second relative moving means for producing relative movement between the container and each of said second cutting means and said third cutting means to enable said second cutting means to cut the edge of the envelope on the second side of the container and said third cutting means to cut the edge of the envelope on the third side of the container;

removal means for removing the cut envelope from the container after said second cutting means and said third cutting means have been effective; and said removal means including:

air pressure means for selectively applying air pressure towards the cut edges of the cut envelope after said second and third cutting means have been effective, said air pressure means being disposed further from the second position than each of said second cutting means and said third cutting means;

and vacuum applying means for selectively applying a vacuum to remove the cut envelope from the container after said air pressure means has been effective.

4. The apparatus according to claim 3 in which said removal means includes force applying means for applying forces to a top and bottom of the cut envelope to partially remove the cut envelope from the container, said force applying means being disposed further from the second position than said air pressure means and closer to the second position than said vacuum applying means.

5. The apparatus according to claim 3 including:

said first relative moving means including first transport means for transporting the container relative to said first cutting means from a first position to a second position;

said second relative moving means including second transport means for transporting the container relative to each of said second cutting means and said third cutting means from the second position to a third the second and third sides of the container being substantially perpendicular to their positions when the container is transported by said first transport means;

and container preventing means for preventing removal of the container from said second transport means by said vacuum applying means.

6. The apparatus according to claim 3 including:

sensing means for sensing the presence of the container at least one selected position after said second cutting means and said third cutting means have been effective, said sensing means controlling when said air pressure means is effective.

7. The apparatus according to claim 3 in which each of said first cutting means, said second cutting means, and said third cutting means includes a rotatable wheel having an angled, flat surface for engaging an edge of the envelope against the container to cut the edge.

8. The apparatus according to claim 5 in which:

one of said second cutting means and said third cutting means is disposed on one side of the travel path of the container from the second position to the third position;

the other of said second cutting means and said third cutting means is disposed on the other side of the travel path of the container from the second position to the third position;

and one of said second cutting means and said third cutting means is closer to the second position than the other of said second cutting means and said third cutting means.

9. The apparatus according to claim 3 in which said air pressure means includes:

first air pressure means for selectively applying pressure towards an edge cut by said second cutting means;

and second air pressure means for selectively applying air pressure towards an edge cut by said third cutting means.

10. The apparatus according to claim 3 including:

said air pressure means including:

first air pressure means for selectively applying pressure towards an edge cut by said second cutting means;

and second air pressure means for selectively applying air pressure towards an edge cut by said third cutting means;

said first relative moving means including first transport means for transporting the container relative to said first cutting means from a first position to a second position;

said second relative moving means including second transport means for transporting the container relative to each of said second cutting means and said third cutting means from the second position to a third position with the second and third sides of the container being substantially perpendicular to their positions when the container is transported by said first transport means;

first engaging means, disposed on the same side of the travel path of the container from the second position to the third position as said second cutting means, for engaging the envelope on the second side of the container prior to said first air pressure means being effective;

and second engaging means, disposed on the same side of the travel path of the container from the second position to the third position as said third cutting means, for engaging the envelope on the third side of the container prior to said second air pressure means being effective.

11. The apparatus according to claim 9 including sensing means for sensing the presence of the container at at least one selected position after said second cutting means and said third cutting means have been effective, said sensing means controlling when each of said first air pressure means and said second air pressure means is effective.

12. The apparatus according to claim 8 including:

first engaging means, disposed on the same side of the travel path of the container from the second position to the third position as said second cutting means, for engaging the envelope on the second side of the container;

and second engaging means, disposed on the same side of the travel path of the container from the second position to the third position as said third cutting means, for engaging the envelope on the third side of the container.

13. The apparatus according to claim 12 in which:

said first transport means includes:

a pair of substantially endless chains;

and each of said chains having container engaging means at the same predetermined spaced intervals for engaging each of the containers to advance each of the containers from the first position to the second position;

said second transport means includes:

a pair of substantially endless chains;

and each of said chains having container engaging means at the same predetermined spaced intervals for engaging each of the containers to advance each of the containers from the second position to the third position;

and driving means for driving each of said chains of said first transport means and each of said chains of said second transport means at the same speed.

14. The apparatus according to claim 2 including:

said first relative moving means including first transport means for transporting the container relative to said first cutting means from a first position to a second position;

said second relative moving means including second transport means for transporting the container relative to each of said second cutting means and said third cutting means from the second position to a third position with the second and third sides of the container being substantially perpendicular to their positions when the container is transported by said first transport means;

and magazine storage means for storing a plurality of containers in a stacked relation at the first position.

15. The apparatus according to claim 3 in which:

said first relative moving means includes first transport means for transporting the container relative to said first cutting means from a first position to a second position;

said second relative moving means includes second transport means for transporting the container relative to each of said second cutting means and said third cutting means from the second position to a third position with the second and third sides of the container being substantially perpendicular to their positions when the container is transported by said first transport means;

said first transport means includes:

a pair of substantially endless chains;

and each of said chains having container engaging means at the same predetermined spaced intervals for engaging each of the containers to advance each of the containers from the first position to the second position;

said second transport means includes:

a pair of substantially endless chains; and each of said chains having container engaging means at the same predetermined spaced intervals for engaging each of the containers to advance each of the containers from the second position to the third position;

and driving means for driving each of said chains of said first transport means and each of said chains of said second transport means at the same speed.

16. The apparatus according to claim 15 including container advancing means for advancing the container towards said vacuum applying means and away from said container engaging means of said second transport means when the container is a predetermined distance from said vacuum applying means.

17. The apparatus according to claim 3 including:

said first relative moving means including first transport means for transporting the container relative to said first cutting means from a first position to a second position;

said second relative moving means including transport means for transporting the container relative to said of said second cutting means and said third cutting means from the second position to a third position with the second and third sides of the container being substantially perpendicular to their positions when the container is transported by said first transport means;

and advancing means for selectively advancing each of the containers to said vacuum applying means independently of said second transport means when each of the containers is at a selected position during its advancement by said second transport means.

18. An apparatus for removing a sealed envelope from at least one rectangular shaped container enclosed by the sealed envelope including:

first cutting means for cutting an edge of a sealed envelope on a first side of a container;

second cutting means for cutting an edge of the envelope on a second side of the container substantially perpendicular to the first side of the container;

third cutting means for cutting an edge of the envelope on a third side of the container substantially parallel to the second side of the container;

first relative moving means for producing relative movement between the container and said first cutting means to enable said first cutting means to cut the edge of the envelope on the first side of the container;

second relative moving means for producing relative movement between the container and each of said second cutting means and said third cutting means to enable said second cutting means to cut the edge of the envelope on the second side of the container and said third cutting means to cut the edge of the envelope on the third side of the container;

removal means for removing the cut envelope from the container after said second cutting means and said third cutting means have been effective;

and each of said first cutting means, said second cutting means, and said third cutting means being a rotatable wheel having an angled, flat surface for engaging an edge of the envelope to cut the edge.

19. The apparatus according to claim 18 including:

first container holding means for holding a first edge of the container in engagement with said angled, flat surface of said rotatable wheel of said first cutting means during advancement of the container by said first transport means past said first cutting means;

second container holding means for holding a second edge of the container in engagement with said angled, flat surface of said rotatable wheel of said second cutting means during advancement of the container by said second transport means past said second cutting means;

and third container holding means for holding a third edge of the container in engagement with said angled, flat surface of said rotatable wheel of said third cutting means during advancement of the container by said second transport means past said third cutting means.

20. An apparatus for removing a sealed envelope from at least one rectangular shaped container enclosed by the sealed envelope including:

first transport means for transporting at least one rectangular shaped container enclosed by a sealed envelope in a first direction from a first position to a second position;

first cutting means for cutting an edge of the sealed envelope on a first side of the container during transport of the container by said first transport means from the first position to the second position;

second transport means for transporting the container in a second direction, substantially perpendicular to the first direction, from the second position to a third position;

second cutting means for cutting an edge of the envelope on a second side of the container substantially perpendicular to the first side of the container during transport of the container by said second transport means from the second position to the third position;

third cutting means for cutting an edge of the envelope on a third side of the container substantially parallel to the second side of the container during transport of the container by said second transport means from the second position to the third position;

removal means for removing the cut envelope from the container during transport of the container from the second position to the third position after said second and third cutting means have been effective;

said first transport means including:

a pair of substantially endless chains;

and each of said chains having container engaging means at the same predetermined spaced intervals for engaging at least the one rectangular shaped container within each of the envelopes to be cut to advance each of the containers within each of the envelopes to be cut from the first position to the second position;

said second transport means including:

a pair of substantially endless chains;

and each of said chains having container engaging means at the same predetermined spaced intervals for engaging at least the one rectangular shaped container within each of the envelopes to be cut to advance each of the containers within each of the envelopes to be cut from the second position to the third position;

and driving means for driving each of said chains of said first transport means and each of said chains of said second transport means at the same speed.

21. An apparatus for removing a sealed envelope in one piece from at least one rectangular shaped container enclosed by the sealed envelope including:

first transport means for transporting at least one rectangular shaped container enclosed by a sealed envelope in a first direction from a first a second position;

first cutting means for cutting an edge envelope on a first side of the container during transport of the container by said first transport means from the first position to the second position;

second transport means for transporting the container in a second direction, substantially perpendicular to the first direction, from the second position to a third position;

second cutting means for cutting an edge of the envelope on a second side of the container substantially perpendicular to the first side of the container during transport of the container by said second transport means from the second position to the third position;

third cutting means for cutting an edge of the envelope on a third side of the container substantially parallel to the second side of the container during transport of the container by said second transport means from the second position to the third position;

removal means for removing the cut envelope in one piece from the container after said second and third cutting means have been effective;

and stopping means for stopping said first transport means and said second transport means only when each of said first cutting means, said second cutting means, and said third cutting means is not being engaged by one of the envelopes to be cut.

22. An apparatus for removing a sealed envelope in one piece from at least one rectangular shaped container enclosed by the sealed envelope including:

first cutting means for cutting an edge of a on a first side of a container;

second cutting means for cutting an edge of the envelope on a second side of the container substantially perpendicular to the first side of the container;

third cutting means for cutting an edge of the envelope third side of the container substantially parallel to the second side of the container;

first relative moving means for producing relative movement between the container and said first cutting means to enable said first cutting means to cut the envelope on the first side of the container;

second relative moving means for producing relative movement between the container and each of said second cutting means and said third cutting means to enable said second cutting means to cut the edge of the envelope on the second side of the container and said third cutting means to cut the edge of the envelope on the third side of the container;

the cut edges of the cut envelope on the first and second sides of the container intersecting to form an intersection;

the cut edges of the cut envelope on the first and third sides of the container intersecting to form an intersection;

removal means for removing the cut envelope from the container in one piece after said second and third cutting means have been effective;

and said removal means including envelope raising means for raising the cut envelope upwardly at the intersection of the cut edges of the cut envelope on the first and second sides of the container and at the intersection of the cut edges of the cut envelope on the first and third sides of the container.

23. The apparatus according to claim 21 in which said envelope raising means includes:

first air pressure means for selectively applying air pressure towards the intersection of the cut edges of the cut envelope on the first and second sides of the container;

and second air pressure means for selectively applying air pressure towards the intersection of the cut edges of the cut envelope on the first and third sides of the container.

24. The apparatus according to claim 22 in which said removal means includes force applying means for applying a force to at least one of the top and bottom of the cut envelope to at least partially remove the cut envelope from the container after said envelope raising means has been effective.

25. An apparatus for removing a sealed envelope in one from at least one rectangular shaped container enclosed by the sealed envelope including:

first cutting means for cutting a first edge of a sealed envelope on a first side of at least one rectangular shaped container;

second cutting means for cutting a second edge of the envelope on a second side of the container substantially perpendicular to the first side of the container;

third cutting means for cutting a third edge of the envelope on a third side of the container substantially parallel to the second side of the container;

each of the first, second, and third cut edges of the envelope and a fourth edge of the envelope on a fourth side of the container substantially parallel to the first side of the container being in the same plane and at least a portion of the fourth edge remaining attached to the rest of the envelope after cutting is completed so that the envelope remains one piece;

first relative moving means for producing relative movement between the container and said first cutting means to enable said first cutting means to cut the first edge of the envelope on the first side of the container;

second relative moving means for producing relative movement between the container and each of said second cutting means and said third cutting means to enable said second cutting means to cut the second edge of the envelope on the second side of the container and said third cutting means to cut the third edge of the envelope on the third side of the container;

and removal means for removing the cut envelope in one piece from the container after said second cutting means and said third cutting means have been effective.

26. An apparatus for removing a sealed envelope from at least one rectangular shaped container enclosed by the sealed envelope including:

first cutting means for cutting an edge of a sealed envelope on a first side of at least one container;

second cutting means for cutting an edge of the envelope on a second side of the container substantially perpendicular to the first side of the container;

third cutting means for cutting an edge of the envelope on a third side of the container substantially parallel to the second side of the container;

first relative moving means for producing relative movement between the container and said first cutting means to enable said first cutting means to cut the edge of the envelope on the first side of the container;

second relative moving means for producing relative movement between the container and each of said second cutting means and said third cutting means to enable said second cutting means to cut the edge of the envelope on the second side of the container and said third cutting means to cut the edge of the envelope on the third side of the container;

removal means for removing the cut envelope from the container after said second cutting means and said third cutting means have been effective;

each of said first, second, and third cutting means being a rotatable wheel;

and each of said rotatable wheels including:

a cylindrical portion rotatable about a rotary axis substantially perpendicular to the direction of relative movement between the container and said rotatable wheel;

and a portion extending from one end of said cylindrical portion towards the container, said extending portion having a substantially flat surface rubbing against the edge of the envelope to cut the edge of the envelope without cutting the edge of the container during rotation of said rotatable wheel when there is relative movement between said rotatable wheel and each of the container and the envelope in a direction substantially parallel to the side of the container having the edge of the envelope being cut bearing thereagainst, said flat surface being at an angle to the edge of the envelope against which said flat surface is rubbing.

27. A rotatable wheel for cutting an edge of a sealed envelope enclosing at least one rectangular shaped container without cutting an edge of the container along a side of the container having the edge of the sealed envelope being cut adjacent thereto, said rotatable wheel including:

a cylindrical portion rotatable about a rotary axis; and means extending from one end of said cylindrical portion towards the container, said extending means having a substantially flat surface rubbing against the edge of the envelope to cut the edge of the envelope without cutting the edge of the container during rotation of said rotatable wheel while there is relative straight movement between said rotatable wheel and each of the container and the envelope in a direction substantially parallel to the side of the container having the edge of the envelope being cut bearing thereagainst and substantially perpendicular to the rotary axis, said flat surface being at an angle to the edge of the envelope against which said flat surface is rubbing.

28. A method for non-manually removing a sealed envelope in one piece from at least one rectangular shaped container enclosed by the sealed envelope including:

cutting a first edge of a sealed envelope on a first side of the container;

cutting a second edge of the envelope on a second side of the container substantially perpendicular to the first side of the container with the second edge being in the same plane as the first edge after cutting of the first edge has been completed;

cutting a third edge of the envelope on a third side of the container substantially parallel to the second side of the container with the third edge being in the same plane as the first edge and the second edge after cutting of at least the first edge has been completed;

leaving at least a portion of a fourth edge of the envelope on a fourth side of the container substantially parallel to the first side of the container and in the same plane as the first edge, the second edge, and the third edge, integral with the rest of the envelope after cutting is completed so that the envelope is one piece;

and removing the cut envelope as one piece from the container after cutting of the first edge, the second edge, and the third edge has been completed.

29. The method according to claim 28 including:

cutting the first edge of the sealed envelope on the first side of the container by producing relative movement between the container and first cutting means;

cutting the second edge of the envelope on the second side of the container by producing relative movement between the container and second cutting means;

cutting the third edge of the envelope on the third side of the container by producing relative movement between the container and third cutting means;

and removing the cut envelope in one piece from the container by selectively applying air pressure towards the cut edges of the cut envelope and then selectively applying a vacuum to remove the cut envelope from the container.

30. The method according to claim 28 including:

cutting the first edge of the sealed envelope on the first side of the container by producing relative movement between the container and a rotatable wheel having a flat surface while rotating the wheel so that the flat surface rubs against the first edge of the envelope and at an angle to the first edge to cut the first edge;

cutting the second edge of the envelope on the second side of the container by producing relative movement between the container and a rotatable wheel having a flat surface while rotating the wheel so that the flat surface rubs against the second edge of the envelope and at an angle to the second edge to cut the second edge;

and cutting the third edge of the envelope on the third side of the container by producing relative movement between the container and a rotatable wheel having a flat surface while rotating the wheel so that the flat surface rubs against the third edge of the envelope and at an angle to the third edge to cut the third edge.

* * * * *

UNITED STATES PATENT AND TRADEMARK OFFICE

CERTIFICATE OF CORRECTION

PATENT NO. : 5,344,274

DATED : September 6, 1994

INVENTOR(S) : Paul R. Everhard et al

It is certified that error appears in the above-identified patent and that said Letters Patent is hereby corrected as shown below:

Column 1, line 51, after "means" insert -- , --
Column 1, line 54, after "container" insert -- . --
Column 2, line 6 should read as follows:
-- effective.
This invention also relates to a method for --
Column 3, line 24, "support" (second occurrence) should read -- supporting --
Column 12, line 18, "124'" should read -- 124 --
Column 15, line 14, "Yi-1" should read -- Yl-1 --
Column 15, line 39, after "see" insert -- FIG. --
Column 15, line 40, "YI-1" should read -- Yl-1 --
Column 17, lines 8 and 9 should read as follows:
-- third position;
third cutting means for cutting a
third edge of the envelope on a third side of the --
Column 17, lines 54-65 should read as follows:
-- said third cutting means have been effective;
and said removal means including:
air pressure means for selectively applying air pressure towards the cut edges of the cut envelope after said second and third cutting means have been effective, said air pressure means being disposed further from the second position than each of said second cutting means and said third cutting means;
and vacuum applying means for selectively applying a vacuum to remove the cut envelope from the container after said air pressure means has been effective. --
Column 18, line 15, after "third" (first occurrence) insert -- position with --

UNITED STATES PATENT AND TRADEMARK OFFICE

CERTIFICATE OF CORRECTION

PATENT NO. : 5,344,274

DATED : September 6, 1994

INVENTOR(S) : Paul R. Everhard et al

It is certified that error appears in the above-identified patent and that said Letters Patent is hereby corrected as shown below:

Column 18, line 24, before "at" insert -- at --
Column 18, line 48, after "applying" insert -- air --
Column 18, line 57, before "pressure" insert -- air --
Column 19, line 54, "2" should read -- 3 --
Column 20, lines 21-24 should read as follows:
-- said second transport means includes:
a pair of substantially endless chains;
and each of said chains having container engaging means at the same predetermined spaced intervals for --
Column 20, line 42, after "including" insert -- second --
Column 20, line 44, "said" (first occurrence) should read -- each --
Column 21, line 23, "transport" should read -- relative moving means --
Column 21, line 29, "transport" should read -- relative moving means --
Column 21, line 35, "transport" should read -- relative moving means --
Column 22, line 28, after "first" (second occurrence) insert -- position to --
Column 22, line 30, after "edge" insert -- of the sealed --
Column 22, line 61, before "on" insert -- sealed envelope --
Column 22, line 67, before "third" insert -- on a --
Column 23, line 27, "21" should read -- 22 --
Column 23, line 39, "the" should read -- a --
Column 23, line 44, before "from" insert -- piece --

UNITED STATES PATENT AND TRADEMARK OFFICE

CERTIFICATE OF CORRECTION

PATENT NO. : 5,344,274

DATED : September 6, 1994

INVENTOR(S) : Paul R. Everhard et al

It is certified that error appears in the above-identified patent and that said Letters Patent is hereby corrected as shown below:

Column 24, lines 66-68 should read as follows:

-- a cylindrical portion rotatable about a rotary axis; and means extending from one end of said cylindrical portion towards the container, said extending --.

Signed and Sealed this

Twenty-ninth Day of November, 1994

*Attest:*

Bruce Lehman

BRUCE LEHMAN

*Attesting Officer*

*Commissioner of Patents and Trademarks*